US011666813B2

(12) United States Patent
Christoph

(10) Patent No.: US 11,666,813 B2
(45) Date of Patent: Jun. 6, 2023

(54) RING AND HOOK GAME APPARATUS

(71) Applicant: Daniel Christoph, Johnston, RI (US)

(72) Inventor: Daniel Christoph, Johnston, RI (US)

( * ) Notice: Subject to any disclaimer, the term of this patent is extended or adjusted under 35 U.S.C. 154(b) by 0 days.

(21) Appl. No.: 17/865,696

(22) Filed: Jul. 15, 2022

(65) Prior Publication Data

US 2023/0126962 A1 Apr. 27, 2023

Related U.S. Application Data

(60) Provisional application No. 63/271,548, filed on Oct. 25, 2021.

(51) Int. Cl.
*A63B 67/10* (2006.01)
*A63B 67/06* (2006.01)

(52) U.S. Cl.
CPC ..... *A63B 67/10* (2013.01); *A63B 67/06* (2013.01); *A63B 2067/063* (2013.01); *A63B 2225/093* (2013.01)

(58) Field of Classification Search
CPC ... A63B 67/06; A63B 67/10; A63B 2067/063; A63F 9/02; A63F 9/0208–2009/0213; A63F 2009/0226
USPC ..... D21/309
See application file for complete search history.

(56) References Cited

U.S. PATENT DOCUMENTS

| | | | | |
|---|---|---|---|---|
| 469,928 | A * | 3/1892 | Blinn | A63F 9/02 273/332 |
| 1,398,511 | A * | 11/1921 | Hanrath | A63B 67/10 273/332 |
| 2,950,918 | A * | 8/1960 | Lyon | A63B 67/10 273/332 |
| 3,520,535 | A | 7/1970 | Dubbs et al. | |
| 5,171,019 | A | 12/1992 | Arnette | |
| 8,011,664 | B2 | 9/2011 | Hilbert, Jr. et al. | |
| 10,625,132 | B2 | 4/2020 | McGetrick | |
| D900,222 | S | 10/2020 | Meyer et al. | |
| 2015/0115530 | A1 | 4/2015 | Vanston | |
| 2016/0339315 | A1 | 11/2016 | McGetrick | |

* cited by examiner

*Primary Examiner* — Laura Davison
(74) *Attorney, Agent, or Firm* — Cooley LLP

(57) ABSTRACT

A hook and ring game apparatus providing a plurality of hook-playing surfaces and offering multiple modalities of tossing the ring in order to couple the ring to a plurality of hooks. The hook and ring game apparatus including a vertical target board, an inclined target board coupled to the vertical target board, and a horizontal arc coupled to the inclined target board, with the horizontal arc including a hook and string, the string having one end secured to the horizontal arc, and a second end attached to the ring.

20 Claims, 9 Drawing Sheets

RING AND HOOK GAME APPARATUS

CROSS-REFERENCE TO RELATED APPLICATION

This application claims priority to and the benefit of U.S. Provisional Application No. 63/271,548, filed Oct. 25, 2021, entitled "Ring and Hook Game Apparatus," the disclosure of which is hereby incorporated by reference in its entirety.

TECHNICAL FIELD

The present disclosure relates to ring and hook games and more specifically to a ring and hook game apparatus including multiple playing surfaces.

BACKGROUND

Traditional ring and hook games comprise a target board with a playing surface, a hook disposed on the playing surface, and a ring attached to a string. The objective of such games typically involves tossing, swinging and/or throwing the ring in a pendulum-like manner with a proper amount of force towards the hook in an effort to ensnare, couple, attach, and/or fasten the ring to the hook. Variants of the game have been known by different names such as "Bimini Toss," "Tikki Toss," and/or "Ring Toss." The layout of existing hook and ring games with a single playing surface provides few options and/or modalities of throwing and/or tossing the ring in order to attach the ring to a hook, which results in limited interest in the game and/or reduced amounts of time that a player finds the game enjoyable. Consequently, there is a need for improved ring and hook games that offer multiple playing combinations and provide different levels of complexity and difficulty increasing the enjoyment and interest of a player on the game.

SUMMARY

Apparatus and methods are described herein for playing a ring and hook game with multiple hook-playing surfaces and modalities of tossing the ring.

In some embodiments, an apparatus comprises: a support component; a first playing surface that is coupled to the support component, the first playing surface defining a first plane and including a plurality of hooks disposed on the first plane; a second playing surface coupled to the support component, the second playing surface defining a second plane different from the first plane, the second playing surface including a second plurality of hooks disposed on the second plane; an anchoring component extending away from the first playing surface and the second playing surface; a string coupled to the anchoring component; and a ring coupled to the string In some embodiments, an apparatus comprises: a first playing surface; a first hook disposed on the first playing surface; a second playing surface oriented at an angle with respect to the first playing surface; a second hook disposed on the second playing surface; an anchoring component extending away from the second playing surface; a string coupled to the anchoring component; and a ring coupled the string.

DETAILED DESCRIPTION

Figure 1:
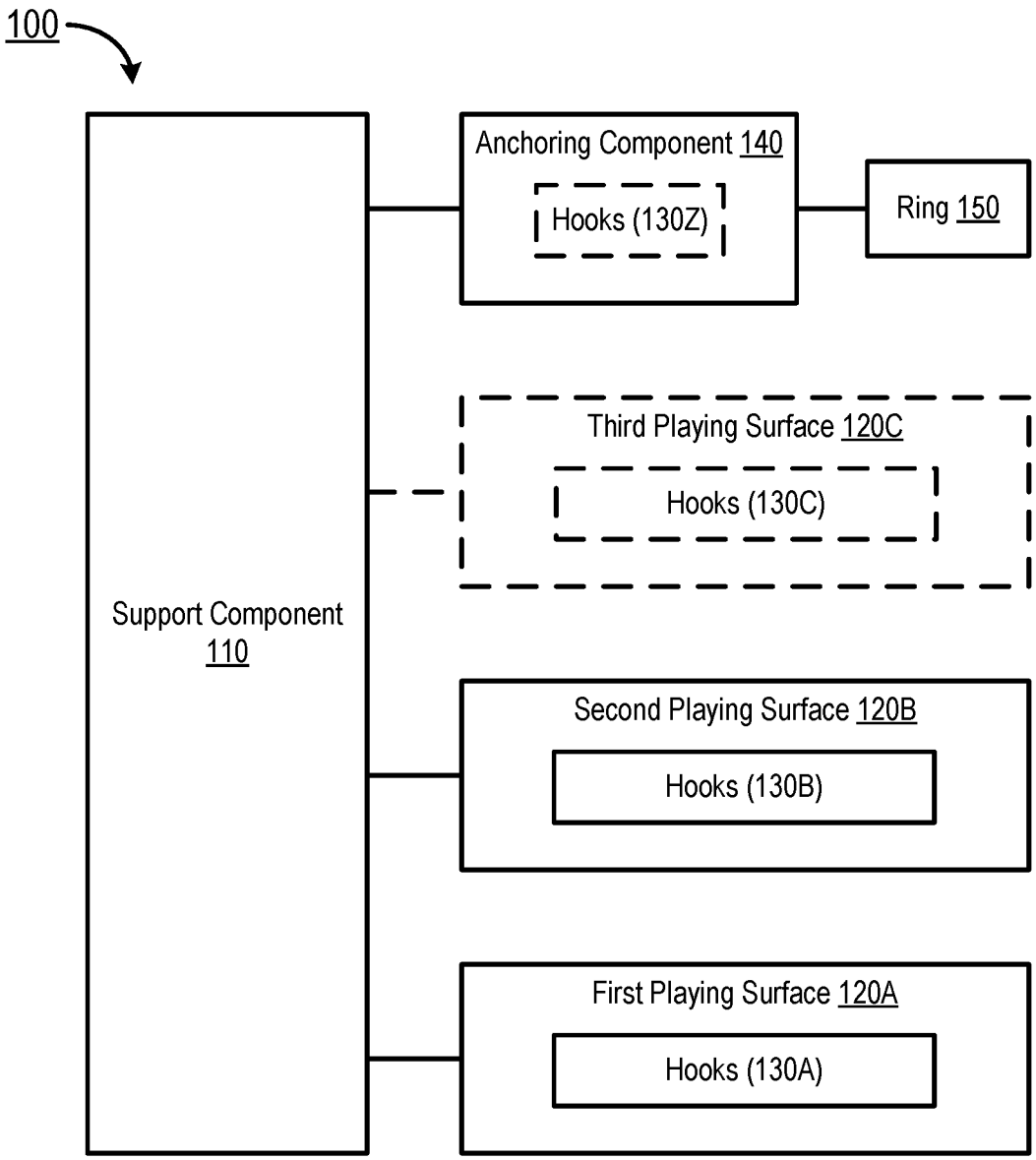
FIG. 1 is a schematic illustration of a game apparatus, according to an embodiment.

Traditional ring and hook games include a target board having a single playing surface, one or more hooks disposed on the playing surface, and a ring attached to one end of a string, while the other end of the string is secured to a surface perpendicular to the playing surface. The typical set-up for such games requires mounting the target board with the hook to a vertical wall and suspending the ring from a string that is secured to a surface perpendicular to the vertical wall (e.g., like a ceiling or the like), at a distance from the target board such that when the ring is tossed, the ring can reach the hook and become ensnared, coupled, attached, and/or fastened to it. Shortcomings of these games include the very limited number of playing surfaces, modalities of tossing the ring, and degrees of complexity and difficulty, which limits the ability of the game to provide continued entertainment. A player and/or a game user can succeed at these ring and hook games by developing a certain degree of manual dexterity and/or eye/hand coordination to toss and/or throw the ring in such a way that the ring follows a specific trajectory and/or path and reaches the hook at an appropriate speed. The specific trajectory typically resembles a parabolic trajectory or a pendulum-like trajectory that starts at the position where a player releases the ring and ends at the position of the target hook, with the ring avoiding coming in contact (e.g., hitting, touching, and/or bumping) with any object and/or surface until reaching the target hook. Players and/or game users can rapidly develop the manual dexterity and eye/hand coordination (e.g., manual skill) required to toss and/or throw the ring to consistently follow the parabolic trajectory required to attach the ring to the hook(s). Once a player has gained the required manual skill to toss and/or throw the ring following the specific trajectory described above, the enjoyment of the game is significantly reduced.

The apparatus described herein address the limitations of existing ring and hook games by providing multiple playing surfaces and various modalities of tossing and/or throwing a ring to attach the ring to a hook. More specifically, the ring and hook game apparatus described herein include a ring secured to a stationary support component via a string or wire, and a plurality of hooks disposed on multiple playing surfaces of a target board, with the playing surfaces having different orientations with respect to the stationary component. The different orientations of the playing surfaces provide a variety of methods and/or modes of tossing the ring with the purpose of coupling the ring to the hooks. In some embodiments, the playing surfaces can include hooks located in hard-to-reach positions that increase the complexity of the game significantly and requires a player to develop and/or explore new ways and/or modalities of tossing the ring. Each method and/or mode of tossing the ring offers a different level of complexity and difficulty, resulting in a large number of playing combinations designed to entertain players of different levels of skills for long periods of time. For example, in some instances a player may be required to toss the ring following a complex trajectory that includes the ring coming into contact with (e.g., hitting, touching, and/or bumping) one or more playing surfaces in order to attach the ring to a target hook.

As used in this specification and in the claims, the singular forms "a," "an," and "the" include plural referents unless the context clearly dictates otherwise. Thus, for example, the term "a member" is intended to mean a single member or a combination of members, "a material" is intended to mean one or more materials or a combination thereof, etc.

As used herein, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

As used herein, the phrase "and/or," should be understood to mean "either or both" of the elements so conjoined (e.g., elements that are conjunctively present in some cases and disjunctively present in other cases). Multiple elements listed with "and/or" should be construed in the same fashion (e.g., "one or more" of the elements so conjoined). Other elements may optionally be present other than the elements specifically identified by the "and/or" clause, whether related or unrelated to those elements specifically identified. Thus, as a non-limiting example, a reference to "A and/or B", when used in conjunction with open-ended language such as "including," "comprising," etc., can refer, in one implementation, to A only (optionally including elements other than B); in another implementation, to B only (optionally including elements other than A); and in yet another implementation, to both A and B (optionally including other elements).

As used herein, the term "or" should be understood to have the same meaning as "and/or" as defined above. For example, when separating items in a list, "or" or "and/or" shall be interpreted as being inclusive (e.g., the inclusion of at least one, but also including more than one) of a number or list of elements, and, optionally, additional unlisted items.

As used herein, the terms "about," "approximately," and/or "substantially" when used in connection with stated value(s) and/or geometric structure(s) or relationship(s) is intended to convey that the value or characteristic so defined is nominally the value stated or characteristic described. In some instances, the terms "about," "approximately," and/or "substantially" can generally mean and/or can generally contemplate a value or characteristic stated within a desirable tolerance (e.g., plus or minus 10% of the value or characteristic stated). For example, a value of about 0.01 can include 0.009 and 0.011, a value of about 0.5 can include 0.45 and 0.55, a value of about 10 can include 9 to 11, and a value of about 1000 can include 900 to 1100.

FIG. 1 shows a schematic illustration of a ring and hook game apparatus 100 according to an embodiment. The ring and hook game apparatus 100 (also referred to herein as "game apparatus" or "apparatus") provides a plurality of hook-playing surfaces, with each playing surface being disposed at a predetermined orientation and including multiples hooks distributed across the playing surface. The orientation of the playing surfaces and the location of the hooks within each playing surface provide multiple degrees of difficulty, as well as multiple modalities of tossing a ring (e.g., multiple ring trajectories) that can be used to ensnare, couple, attach, and/or fasten the ring to the hooks.

FIG. 1 shows the game apparatus 100 includes a support component 110, a first playing surface 120A, a second playing surface 120B, an anchoring component 140, and a ring 150. Optionally, in some embodiments, the game apparatus 100 can include a third playing surface 120C, a fourth playing surface (not shown), and so on. The support component 110 can be configured to provide structural support and facilitate assembly of the game apparatus 100. The support component 110 can be mechanically coupled to the anchoring component 140 and to the playing surfaces 120, which include the first playing surface 120A, the second playing surface 120B, the optional third playing surface 120C, and any optional fourth, fifth, or more playing surfaces. The support component can be coupled to the playing surfaces 120 such that each playing surface is disposed at a predetermined orientation with respect to a reference plane such as the ground and/or floor where the game apparatus 100 is disposed on, as further described herein.

The playing surfaces 120 can include a plurality of hooks 130. For example, as shown in FIG. 1, the playing surfaces 120A, 120B, and 120C can each include one or more hooks 130A, 130B, 130C (collectively referred to herein as "hooks 130"). The hooks 130 can be disposed on their respective playing surfaces at any suitable position and/or location within the playing surface such that the hooks 130 provide different degrees of difficulty and/or different trajectories required to successfully ensnare, couple, attach, and/or fasten the ring 150 to the hooks, as further described herein. The anchoring component 140 can be a structure coupled to the support component 110 and configured to provide an anchoring point to suspend the ring 150 from a string such that the ring can be tossed by a player following different trajectories to and/or modalities with the purpose of ensnare, couple, attach, and/or fasten the ring 150 to the hooks 130.

The support component 110 can be any suitable structure configured to provide mechanical support to the components of the game apparatus 100 including the playing surfaces 120, and/or the anchoring component 140. In some embodiments the support component 110 can include one or more columns, pillars, poles, and/or legs (not shown) configured to be coupled to the components of the game apparatus 100 to provide a rigid structure that supports the weight of the game apparatus 100. In some embodiments the support component 110 can include a frame, mount, stand and/or the like (not shown) configured to be coupled to the components of the game apparatus 100. The frame, mount, stand and/or the like can be formed of any number of struts, beams, plates, posts or a combination thereof, coupled together using various coupling mechanisms including, but not limited to bolts, nails, fasteners, welding, brazing, adhesives and the like. The struts, beams, plates, and/or posts can be made of materials having suitable mechanical properties such as high strength, toughness, rigidity, hardness, and/or stiffness. For example, in some embodiments the struts, beams, plates, posts of the frame of the support component can be made of aluminum, steel, stainless steel, bronze, wood, polyethylene (PE), high density polyethylene (HDPE), Polypropylene (PP), polystyrene (PS), polyvinyl chloride (PVC) and the like, or any combination thereof. In some embodiments the support component 110 can include a plurality of legs (not shown) having a three-dimensional shape defined by a length and any suitable cross-sectional area including, for example, circular, oval, square, rectangular, and/or other polygonal shape. The cross-sectional area of the legs can be selected to be sufficiently large in order to provide adequate structural strength and facilitate supporting the weight of the components of the game apparatus 100 using a reduced number of legs. For example, in some embodiments the support component 110 can have a relatively large cross-sectional area such that the game apparatus 100 can be supported with one or two legs. In other embodiments, the legs can have a relatively small cross-sectional area and the support component 110 can include two or more legs that can be coupled to the components of the game apparatus 100 at different points to provide adequate mechanical support.

The length of the legs can have an impact on the relative position and/or height of the playing surfaces 120 with respect to the ground (or a reference horizontal surface and/or floor over which the game apparatus 100 is placed). The height of the playing surfaces 120 with respect to the ground can influence the amount of force, the angle, and the trajectory required to toss the ring 150 in order to ensnare, couple, attach, and/or fasten the ring to a hook. In some embodiments, the support component 110 can include a plurality of legs having multiple attachment points disposed across the length of the legs. The attachment points can be configured to facilitate removably coupling the playing surfaces 120 such that the playing surfaces 120 can be disposed at different heights with respect to the ground, to provide distinct levels of difficulty and/or complexity for tossing the ring 150. In some embodiments, the attachment points can include one or more coupling features that facilitate removably coupling the playing surfaces 120 at predetermined positions along the length of the legs such that the height of the playing surfaces 120 can be adjusted. In some embodiments, the support component 110 can be removably coupled to the playing surfaces 120 using bolts, fasteners, screws, rivets, anchors and/or any other coupling methods.

In some embodiments, the support component 110 can include multiple portions that can be coupled and/or assembled together to form a rigid structure for receiving and/or supporting the weight of the components of the game apparatus 100. That is, in some embodiments, the support component 110 can be modular. Alternatively, in other embodiments, support component 110 can be a monolithic structure. The support component 110 can include any suitable parts, pieces, portions, and/or subcomponents configured to increase the stability of the game apparatus 100. For example, in some embodiments, the support component 110 can include a plurality of legs (not shown), with each leg having a base structure (not shown) that (1) is disposed on one end of the leg, and (2) is sized and shaped to increase the contact area between the game apparatus 100 and the floor and/or the surface over which the game apparatus 100 is placed. The base structure can increase the contact area between the game apparatus and the floor, thus improving the mechanical stability of the game apparatus 100 and preventing the game apparatus 100 from tipping over and falling. The base structure can be any suitable shape, and size. For example, in some embodiments the base structure can be a three-dimensional shape defined by a length and a suitable cross-sectional area such as square, rectangular, circular, polygonal and the like. In some embodiments the base structure can be a square shape with a cross-sectional area larger than the cross-sectional area of the legs of the support component 110.

The base structure can be coupled to the supporting legs using various coupling mechanisms including, but not limited to bolts, fasteners, nails, adhesives, welding, brazing or any combination thereof. In some embodiments the base structure can be a pedestal-like shape that includes a first portion including an opening configured to receive one end of a supporting leg 110, and a second portion adjacent to the first portion, and configured to increase the contact area between the supporting leg 110 and the ground to increase the stability of the game apparatus 100. Alternatively, in some embodiments, the support component 110 or the base structure can include a one or more wheels sized and configured to facilitate movement of the game apparatus 100 without removing and/or decoupling one or more component of the game apparatus 100

The support component 110 and/or their subcomponents can made be of any suitable material configured to provide sufficient mechanical strength and/or rigidity to support the weight if the components of the game apparatus 100. For example, in some embodiments the support component 110 can be formed from one or more materials including wood, aluminum, steel, stainless steel, polyethylene (PE), polyvinyl chloride (PVC), polycarbonates, poly(methyl methacrylate), fiberglass, carbon fiber, and/or the like. In some embodiments, a protective coating can be applied on the surface of the support component 110 to provide resistance to corrosion from to exposure to the sun, rain, snow, and other environmental factors. The coating can be various materials including, but not limited to polyurethane, epoxies, zinc oxide, copper, and/or the like. In some embodiments, a coating can be applied on the surface of the support component 110 to impart an ornamental aspect.

The first playing surface 120A can be any suitable structure that defines a first plane or surface over which multiple hooks 130A can be attached and/or coupled. The first playing surface 120A can have any suitable shape. For example, in some embodiments the first playing surface 120A can define a substantially flat and/or planar surface and/or a first plane over which the hooks 130A can be attached and/or coupled. Alternatively, in some embodiments the first playing surface 120A can define a curved surface over which the hooks 130A can be attached and/or coupled. The first playing surface 120A can be coupled to the support component 110 such that the first playing surface 120A is disposed at a predetermined orientation with respect to the ground and/or floor on which the game apparatus 100 is being disposed on. For example, in some embodiments the first playing surface 120A can be coupled to the support component 110 such that the first playing surface 120A is oriented at a 90-degree angle (e.g., perpendicular) with respect to the ground and/or floor on which the game apparatus 100 is being disposed on. That is, the first plane defined by the first playing surface 120A and a plane defined by the ground and/or floor on which the game apparatus is disposed can form and/or determine a 90-degree angle. Alternatively, in some embodiments the first playing surface 120A can be coupled to the support component 110 such that the first playing surface 120A is oriented at a predetermined angle larger than 90 degrees with respect to the ground and/or floor on which the game apparatus 100 is being disposed on (the first plane and the plane defined by the ground form and/or determine an angle larger than 90-degrees). In yet other embodiments, the first playing surface 120A can be coupled to the support component 110 such that the first playing surface 120A is oriented at a predetermined angle smaller than 90 degrees with respect to the ground and/or floor on which the game apparatus 100 is being disposed on (the first plane and the plane defined by the ground form and/or determine an angle smaller than 90-degrees). In some embodiments, the first playing surface 120A can be removably coupled to the support component 110 in such a manner that the orientation of the first playing surface 120A can be adjusted buy a user. For example, in some embodiments the first playing surface 120A can include a panel that can be removably coupled to the support component 110 with the aid of one or more coupling features, with the coupling features allowing to adjust the angle of the panel with respect to the ground and/or floor on which the game apparatus 100 is being disposed on.

The first playing surface 120A can be any suitable shape and size. In some embodiments the first playing surface 120A can be a shape defined by a thickness and any suitable cross-sectional area including, circular, oval, square, rectangular, polygonal, and/or an irregular cross-sectional area. For example, in some embodiments the first playing surface 120A can include a panel having a suitable thickness and a substantially flat rectangular cross-sectional area defined by a width and a height.

The first playing surface 120A can be made of any suitable material including, but not limited to wood, polyethylene (PE), high density polyethylene (HDPE), Polypropylene (PP), polystyrene (PS), polyvinyl chloride (PVC), Aluminum, Steel, stainless steel, polycarbonates and/or the like. In some embodiments the first playing surface 120A can include multiple panels of similar same cross-sectional area stacked together to produce a thick structure that exhibits sufficient rigidity to support the weight of the hooks 130A attached to the first playing surface 120A and prevent deformation of the cross-sectional area defined by the boards. In some embodiments, the panels can all be made of the same material, while in other embodiments the panels can be made of different materials. For example, in some embodiments the first playing surface 120A can include one or more stacked panels made of a material that exhibits mechanical properties suitable for machining and coupling a plurality of hooks 130A (e.g., materials with adequate density, hardness, and/or toughness such as wood) and one or more panels made of materials that exhibit high tensile strength such as steel, providing rigidity to the first playing surface 120A.

FIG. 1 shows the first playing surface 120A can include one or more hooks 130A coupled to the first playing surface 120A. Similarly, the second playing surface 120B, the third optional playing surface 120C, and/or any additional optional playing surface not shown in FIG. 1 (e.g., a fourth optional playing surface 120D, a fifth optional playing surface 120E and so on), can each include one or more hooks 130B, 130C, as well as optional hooks 130D, and 130E (not shown in FIG. 1). The hooks 130A, 130B, 130C, 130D, and 130E can collectively be referred to as "the hooks 130" herein. The hooks 130 can be any suitable size and configuration. For example, in some embodiments, the hooks 130 can be screw-in hooks, magnet mounted hooks, undermount hooks, vacuum hooks, or the like. The hooks 130A can be made of any suitable material including metals such as aluminum, copper, steel, stainless steel, brass, bronze, zinc, polymeric materials such as nylon, polyamide, polycarbonate, polyester, polyethylene, polypropylene, PVC, and/or other materials including wood, and/or rubber. The hooks 130 can be disposed and/or positioned at any suitable section and/or portion of the playing surfaces 120 with the purpose of providing different levels of difficulty for the ring 150 to be ensnared, coupled, attached, and/or fastened to the hooks 130. For example, in some embodiments, the first playing surface 120A can include one or more hooks 130A disposed on a central region, section and/or portion for the first playing surface 120A, and one or more hooks 130A disposed on outer and/or edge region of the first playing surface 120A. In some embodiments, one or more hook 130A can be disposed on a platform (not shown) disposed on the first playing surface 120A. The platform can be any suitable height such that the hook(s) 130A are disposed at a predetermined distance and/or orientation from the first playing surface 120A in order to provide a specific degree of difficulty for tossing of the ring 150 to ensnare, couple, attach, and/or fasten the ring 150 to the hook 130A.

The hooks 130 can include multiple components including a base, and one or more primary shanks. For example, in some implementations, a hook 130 can include a base, and a single primary shank (not shown in FIG. 1). In other implementations, a hook 130 can include a base and two or more primary shanks configured to provide a surface over which the ring 150 can be attached to. Moreover, in some implementations, the hooks 130 can include a removably couplable hook-extender component (not shown in FIG. 1) which can increase the number of available shanks that provide a surface to which the ring 150 can be attached to. In use, the hook extender component can be coupled to a hook 130 to increase the total number of shanks available for ensnaring, coupling, attaching, and/or fastening the ring 150 to the hook 130, as further described herein.

The second playing surface 120B can be any suitable structure that defines a second plane and/or surface over which a plurality of hooks 130B can be attached and/or coupled. The second playing surface 120B over which the hooks 130B are attached can have any suitable shape. For example, in some embodiments the second playing surface 120B can define a substantially flat and/or planar surface and/or second plane over which the hooks 130B can be attached and/or coupled. Alternatively, in some embodiments the second playing surface 120B can define a curved surface over which the hooks 130B can be attached and/or coupled. In some embodiments, portions and/or aspects of the second playing surface 120B can be similar to and/or substantially the same as portions and/or aspects of the first playing surface 120A described above. Accordingly, such similar portions and/or aspects of the second playing surface 120B may not be described in further detail herein.

In some embodiments the second playing surface 120B can be coupled to the support component 110 and/or the first playing surface 120A such that the second playing surface 120B is disposed adjacent to the first playing surface 120A.

In such embodiments, the second playing surface 120B can include a boundary, border, side, and/or edge that is disposed adjacent to a boundary, border, side, and/or edge of the first playing surface 120A. Alternatively, in other embodiments the second playing surface 120B can be coupled to the support component 110 such that the second playing surface 120B is not adjacent to the first playing surface 120A. That is, the second playing surface 120B and the first playing surface 120A can be coupled to the support component such that there is a gap between the boundaries, borders, sides, and/or edges of the playing surfaces 120A and 120B.

The second playing surface 120B can be any suitable size and/or shape. For example, in some embodiments the second playing surface 120B can be a shape defined by a thickness and any suitable cross-sectional area including, circular, oval, square, rectangular, polygonal, and/or an irregular cross-sectional area. In some embodiments the second playing surface 120B can be a shape substantially similar to the shape of the first playing surface 120A. In other embodiments, the second playing surface 120B can be a shape different from the shape of the first playing surface 120A. In some embodiments the second playing surface 120B can be coupled to the support component 110 such that the first playing surface 120A and the second playing surface 120B define an angle "θ." Said in other words, the first plane defined by the first playing surface 120A and the second plane defined by the second playing surface 120B can define an orientation angle "θ." In some embodiments, the support component 110 can include an orientation component (not shown in FIG. 1) configured to couple, secure, and/or attach the second playing surface 120B to the support component 110 and/or to the first playing surface 120A. In such embodiments, the second playing surface 120B is disposed adjacent to the first playing surface 120A and oriented such that the first plane defined by the first playing surface 120A and the second plane defined by the second playing surface 120B intersect forming and/or defining the angle "θ." In some embodiments the orientation component be one or more brackets, hinges, and/or braces comprising a first surface that can be coupled and/or attached to the first playing surface 120A, and a second surface configured to be coupled to the second playing surface 120B or a component thereof, such that the second playing surface 120B is secured to the game apparatus 100 and oriented at the angle "θ" with respect to the first playing surface 120A.

The angle "θ" that defines the orientation of the second playing surface 120B with respect to the first playing surface 120A can assume any suitable value. For example, in some embodiments the angle "θ" can be at least about 30°, at least about 35°, at least about 40°, at least about 45°, at least about 50°, at least about 55°, at least about 60°, at least about 65°, inclusive of all values and ranges therebetween. In some embodiments the angle "θ" can be no more than about 65°, no more than about 60°, no more than about 56°, no more than about 65°, no more than about 58°, no more than about 54°, no more than about 50°, no more than about 46°, no more than about 42°, no more than about 38°, no more than about 34°, no more than about 30°, inclusive of all values and ranges therebetween. Combinations of the above referenced ranges for the angle "θ" are also possible (e.g., an angle "θ" of at least about 38° to no more than about 60°, at least about 55° to no more than about 65°).

The orientation component can be made of any suitable material, including wood, polyethylene (PE), high density polyethylene (HDPE), Polypropylene (PP), polystyrene (PS), polyvinyl chloride (PVC), Aluminum, Steel, stainless steel, polycarbonates and/or the like. In some embodiments the orientation component can be coupled to the second playing surface 120B and to the first playing surface 120A (or a portion thereof), via any suitable coupling mechanism including, but not limited to bolts, fasteners, nails, adhesives, welding, brazing or any combination thereof.

The second playing surface 120B can include one or more hooks 130B coupled to the second playing surface 120B as shown in FIG. 1. The hooks 130B can be the same as or similar to the hooks 130 described above. Accordingly, the hooks 130B will not be further described herein.

In some embodiments, the second playing surface 120B can optionally include a rotating mechanism (not shown in FIG. 1) configured to change the orientation of the hooks 130B with respect to the second playing surface 120B, to facilitate decoupling a ring 150 ensnared and/or attached to one of the hooks 130B. The rotating mechanism can be included to facilitate removing a ring 150 that has been ensnared, coupled, attached, and/or fastened to a hook 130B disposed at a hard-to-reach area of the second playing surface 120B (e.g., an area located at a distance from the ground or floor where the game apparatus 100 is disposed which far exceeds the height of a player and/or game user). For example, in some instances the rotating mechanism can facilitate rotating a hook 130B such that a shank of the hook (e.g., an end portion of the hook to which the ring is attached to when tossed) becomes upside down and the ring 150 can fall from the hook 130B. The rotating mechanism can assist decoupling the ring 150 from a hook 130B disposed on a hard-to-reach area of the game apparatus 100. The rotating mechanism can change the orientation of one or more hooks 130B to facilitate decoupling the ring 150 when the ring 150 is successfully attached to a hook 130B. In some embodiments, the rotating mechanism can include a pulley, rope, wire, or the like and a plurality of rotating plates and/or bases to which the hooks 130B are mounted to. In some embodiments the rotating mechanism can be activated by manually pulling the rope in a predetermined direction. The rope can cause the rotating base to rotate clockwise or counter-clockwise up to 360 degrees to change the orientation of the hooks 130B in order to release the ring 150 from the hooks 130B when the ring 150 is attached thereto.

The optional third playing surface 120C, as well as any other optional playing surface included in the game apparatus 100 not shown in FIG. 1_(e.g., a fourth optional playing surface 120D, a fifth optional playing surface 120E, and so on) can be any suitable structure that defines a surface and/or plane over which a plurality of hooks 130 (e.g., 130C, and/or the optional hooks 130D, 130E and so on, not shown in FIG. 1) can be attached and/or coupled. In some embodiments, portions and/or aspects of the optional playing surfaces 120C, 120D, 120E and the like can be similar to and/or substantially the same as portions and/or aspects of the first playing surface 120A and/or the second playing surface 120B described above. Accordingly, such similar portions and/or aspects of the optional playing surfaces 120C, 120D, 120 E and the like may not be described in further detail herein.

In some embodiments the optional playing surfaces 120C, as well as any other optional playing surfaces 120D, 120E and the like (not shown in FIG. 1) can define one or more surfaces over which multiple hooks 130 (e.g., 130C, as well as 130D, 130E and the like, not shown in FIG. 1) can be disposed, with the surfaces being substantially planar, curved, and/or any other suitable shape. In some embodiments, the optional playing surfaces 120C, 120D, 120E and the like can be coupled to the support component 110 such that the optional playing surfaces 120C, 120D, 120E and the like are disposed adjacent to at least one of the first playing surface 120A and/or the second playing surface 120B. In such embodiments, the optional playing surfaces 120C, 120D, 120E and the like can include a boundary, border, side, and/or edge that is disposed adjacent to a boundary, border, side, and/or edge of the first playing surface 120A and/or adjacent to a boundary, border, side, and/or edge of the second playing surface 120B. Alternatively, in other embodiments the optional playing surfaces 120C, 120D, 120E and the like can be coupled to the support component 110 such that the first playing surface 120A and the second playing surface 120B are not adjacent to one or more of the playing surfaces 120C, 120D, 120E and the like. That is, the playing surfaces 120C, 120D, 120E and the like and the first playing surface 120A and/or the second playing surface 120B can be coupled to the support component 110 such that there are one or more gaps between a boundary, border, side, and/or edge of the first playing surfaces 120A and/or the second playing surface 120B, and one or more boundaries, borders, sides, and/or edges of the optional playing surfaces 120C, 120D, 120E and the like.

In some embodiments the optional playing surface 120C, as well as any other optional playing surfaces 120D, 120E and the like (not shown in FIG. 1) can be coupled to the support component 110 such that the planes defined by the optional playing surfaces and the first plane defined by the playing surface 120A form and/or define an angle "θ." The angle "θ" that defines the orientation of the one or more playing surfaces 120C, 120D, 120E and the like with respect to the first playing surface 120A can assume any suitable value. For example, in some embodiments the angle "θ" can be at least about 30°, at least about 35°, at least about 40°, at least about 45°, at least about 50°, at least about 55°, at least about 60°, at least about 65°, inclusive of all values and ranges therebetween. In some embodiments the angle "θ" can be no more than about 65°, no more than about 60°, no more than about 56°, no more than about 65°, no more than about 58°, no more than about 54°, no more than about 50°, no more than about 46°, no more than about 42°, no more than about 38°, no more than about 34°, no more than about 30°, inclusive of all values and ranges therebetween. Combinations of the above referenced ranges for the angle "θ" are also possible (e.g., an angle "θ" of at least about 38° to no more than about 60°, at least about 55° to no more than about 65°).

The anchoring component 140 can be an elongated structure configured to provide an anchoring point from which the ring 150 can be suspended from. The anchoring component 140 can be coupled to support component 110 as shown in FIG. 1. In other embodiments, the anchoring component 140 can be coupled to the support component 110 and/or to the playing surfaces 120. In some embodiments the anchoring component 140 can be cantilevered to at least one of the playing surfaces 120 (e.g., the first playing surface 120A, the second playing surface 120B, the optional third playing surface 120C or any other optional playing surface) by one of its ends, extending out from the at least one of the playing surfaces 120 in a horizontal direction. The anchoring component 140 can have a shape defined by a length and any suitable geometric cross-sectional including circular, triangular, square, rectangular, and/or polygonal. In some embodiments the anchoring component 140 can be an elongated straight shape. Alternatively, in some embodiments the anchoring component 140 can be an elongated shape having a curvature such as a convex or concave arch. The anchoring component 140 can be made of any suitable material including aluminum, steel, stainless steel, copper, brass, Nickel, wood, PE, PVC, polycarbonates, poly(methyl methacrylate), fiberglass reinforced plastics, carbon fiber, and/or the like. In some embodiments the anchoring component 140 can be coupled to the support component 110 and/or to any of the playing surfaces by any suitable means, including bolts, fasteners, nails, adhesives, welding, brazing or any combination thereof.

The anchoring component 140 can include one or more hooks 130Z, as shown in FIG. 1. The hooks 130Z can be disposed at any suitable position along the length of the anchoring component 140. In some embodiments the anchoring component 140 can include one hook 130Z positioned on the anchoring component 140 at a distance that corresponds to the midpoint between the two ends of the anchoring component 140, as further described herein.

The hooks 130Z can be the same as or substantially similar to the hooks 130A, 130B, and 130C described above with respect to the first playing surface 120A, the second playing surface 120B, and the optional third playing surface 120C, respectively. Accordingly, the hooks 130Z will not be further described herein.

The anchoring component 140 can provide an anchoring point from which the ring 150 can be mechanically coupled and/or suspended from. The anchoring component 140 can include a string, cord, rope, wire, cable, line or the like (not shown) having a first end that can be secured to an end-portion of the anchoring component 140 distal to the game apparatus 100, and a second end that can be attached to the ring 150. In some embodiments the string can be made of a flexible material. In some embodiments the string can be a rope, cord, chain, twisted twine, fishing line or the like, having sufficient strength and tension to tether the ring 150 to one of its ends. In some embodiments, the string can be an elasticized cord such as a bungee cord or the like. The string can be secured and/or attached to the anchoring component 140 by any suitable means including knots, adhesives, and the like.

The string of the anchoring component 140 can be configured to facilitate a player to toss the ring 150 towards the playing surfaces of the game apparatus 100 such that the ring 150 traverses from the hand of the player to the playing surfaces 120 of the game apparatus 100 attached to the anchoring component 140 via the string. In some instances, the string can facilitate tossing the ring 150 in a pendulum-like trajectory (e.g., a direct path throw) starting from the hand of a player and ending on a hook 130 of the playing surfaces 120 in an effort to ensnare, couple, attach, and/or fasten the ring 150 to the hooks 130 of the game apparatus 100. In other instances, the string can facilitate tossing the ring 150 according to a multi-step trajectory in which the ring impacts one or more playing surfaces of the game apparatus 100 prior to reaching a target hook 130 in an effort to ensnare, couple, attach, and/or fasten the ring to the target hook, as further described herein The ring 150 can be any suitable structure that approximates a circular torus for at least part of its length. Alternatively, in some embodiments the ring 150 can be a ring-like member having a shape that can fit around the hooks 130, such as for example, a triangle, rectangle, square, and/or a polygon. The ring 150 can be made of any suitable material including wood, polyethylene (PE), high density polyethylene (HDPE), Polypropylene (PP), polystyrene (PS), polyvinyl chloride (PVC), Aluminum, Steel, stainless steel, polycarbonates and/or the like.

As described above, the game apparatus 100 provides a plurality of hook-playing surfaces, offering different degrees of difficulty, and multiple modalities of tossing the ring 150

(e.g., multiple ring 150 trajectories) to ensnare, couple, attach, and/or fasten the ring 150 to a hook 130. In some embodiments, each hook 130 can be assigned a separate score and/or point value that can be awarded to the player that successfully tosses the ring 150 and ensnares, couples, attaches, and/or fastens the ring 150 to that particular hook 230, as further described herein The game apparatus 100 can be used to play different types of games. For example, in some instances one or more players can use the game apparatus 100 to play a "fixed number of throws" game. In the "fixed number of throws" game each player is allowed to toss the ring 150 a fixed number of times. In some implementations, each player can execute all his/her allowed throws continuously and uninterruptedly, one player at a time. That is, a first player can be allowed to execute all his/her allowed number of throws continuously and uninterruptedly until completing the total number allowed throws. Then a second player can be allowed to execute all his/her allowed number of throws continuously and uninterruptedly until completing the total number allowed throws. This procedure can be followed until all the players execute all their allowed number of throws. Alternatively, in other implementations each player is allowed to execute a subset of throws one player at a time until all the players execute their subset of throws. This procedure can be repeated until all the players have executed their total number of throws. Each player can be assigned a total score based on the number of throws that were successfully ensnared, coupled, attached, and/or fastened to each hook and the score and/or point value of each one of those hooks. The player that archives the highest score wins the fix number of throws game In some instances, one or more players can use the game apparatus 100 to play an "all-hooks" game. In the "all-hooks" game the players are allowed to execute one throw at a time sequentially (e.g., one player after the other) until a player successfully ensnares, couples, attaches, and/or fastens the ring 150 to each one of the hooks 130 in the game apparatus 100 (or a pre-defined subset thereof). Said in other words, the first player to successfully couple the ring 150 at least one time to each one of the hooks 130 wins the "all-hooks" game".

As described above, the game apparatus 100 offers multiple modalities of tossing the ring 150 (e.g., multiple ring 150 trajectories) to ensnare, couple, attach, and/or fasten the ring 150 to a hook 130. For example, in some instances a player can execute a "direct path" throw. In the "direct path throw" the ring 150 follows a trajectory and/or path from a hand of the player directly to a hook 130 to which the player attempts to ensnare, couple, attach, and/or fasten the ring 150 (e.g., a target hook 130). In the "direct path" throw the ring 150 does not come in contact (e.g., hits, touches, or bumps) with any component and/or surface of the game apparatus 100 before attaching to the indented target hook 130.

In other instances, a player can execute a "one-stop" throw to ensnare, couple, attach, and/or fasten the ring 150 to a target hook 130. In the "one-stop" throw the ring 150 follows a trajectory from a hand of a player to the target hook 130, with the ring 150 contacting a first point and/or small area of the game apparatus 100 (e.g., a playing surface 120) prior to reaching the target hook. In the "one-stop" throw the player can toss the ring 150 such that the ring 150 is released from the hand of the player to follow a first predetermined trajectory or path until coming in contact (e.g., hitting, touching and/or bumping) with a point and/or small area of the game apparatus 100 (e.g., a point and/or small area of the support component 110, the first playing surface 120A, the second playing surface 120B, or one of the optional playing surfaces 120C, 120D and the like not shown in FIG. 1). The ring 150 can then rebound off the small area of the game apparatus 100 and follow a second trajectory until reaching the target hook 130 to which the ring 150 is intended to be ensnared, coupled, attached, and/or fastened.

In yet other instances, a player can execute a "two-stop" throw to ensnare, couple, attach, and/or fasten the ring 150 to a target hook 130. In the "two-stop" throw the ring 150 follows a trajectory from a hand of a player to the target hook 130, with the ring 150 contacting a first point and/or small area of the game apparatus 100, and then a second point and/or small area of the game apparatus 100 (the second point being different from the first point), prior to reaching the target hook. In the "two-stop" throw the player can toss the ring 150 such that the ring 150 is released from the hand of the player to follow a first trajectory or path until coming in contact (e.g., hitting, touching and/or bumping) with a first point and/or first small area of a playing surface of the game apparatus 100 (e.g., a first point and/or first small area of either the support component 110, the first playing surface 120A, the second playing surface 120B, or one of the optional playing surfaces 120C, 120D and the like not shown in FIG. 1). The ring 150 can then rebound off the first small area of the game apparatus 100 and follow a second trajectory until reaching a second point and/or second small area of the game apparatus 100 (e.g., a second point and/or second small area of either the support component 110, the first playing surface 120A, the second playing surface 120B, or one of the optional playing surfaces 120C, 120D and the like, different from the first point and/or first small area). The ring 150 can then rebound off the second small area of the game apparatus 100 and follow a third trajectory until reaching the target hook 130 in which the ring 150 is intended to be ensnared, coupled, attached, and/or fastened to.

In some embodiments, the game apparatus 100 can be configured such that a player may be able to toss an "n-stops" throw to ensnare, couple, attach, and/or fasten the ring 150 to a target hook, with n being any suitable number of stops. In the "n-stops" throws a player can toss the ring 150 such that the ring 150 is released from the hand of the player to follow a succession of "n+1" trajectories coming in contact (e.g., hitting, touching and/or bumping) with n points and/or small areas of the game apparatus 100 prior to reaching the target hook 130. In some instances, the "n-stops" throw can include coming in contact with points and/or small areas corresponding to each playing surface 120 of the game apparatus 100. In other instances, the "n-stops" throw can include coming in contact with only a subset of playing surfaces 120 of the game apparatus 100 while avoiding coming in contact with the rest of the playing surfaces 120 of the game apparatus 100 (e.g., the playing surfaces 120 not included in the subset).

Figure 2:
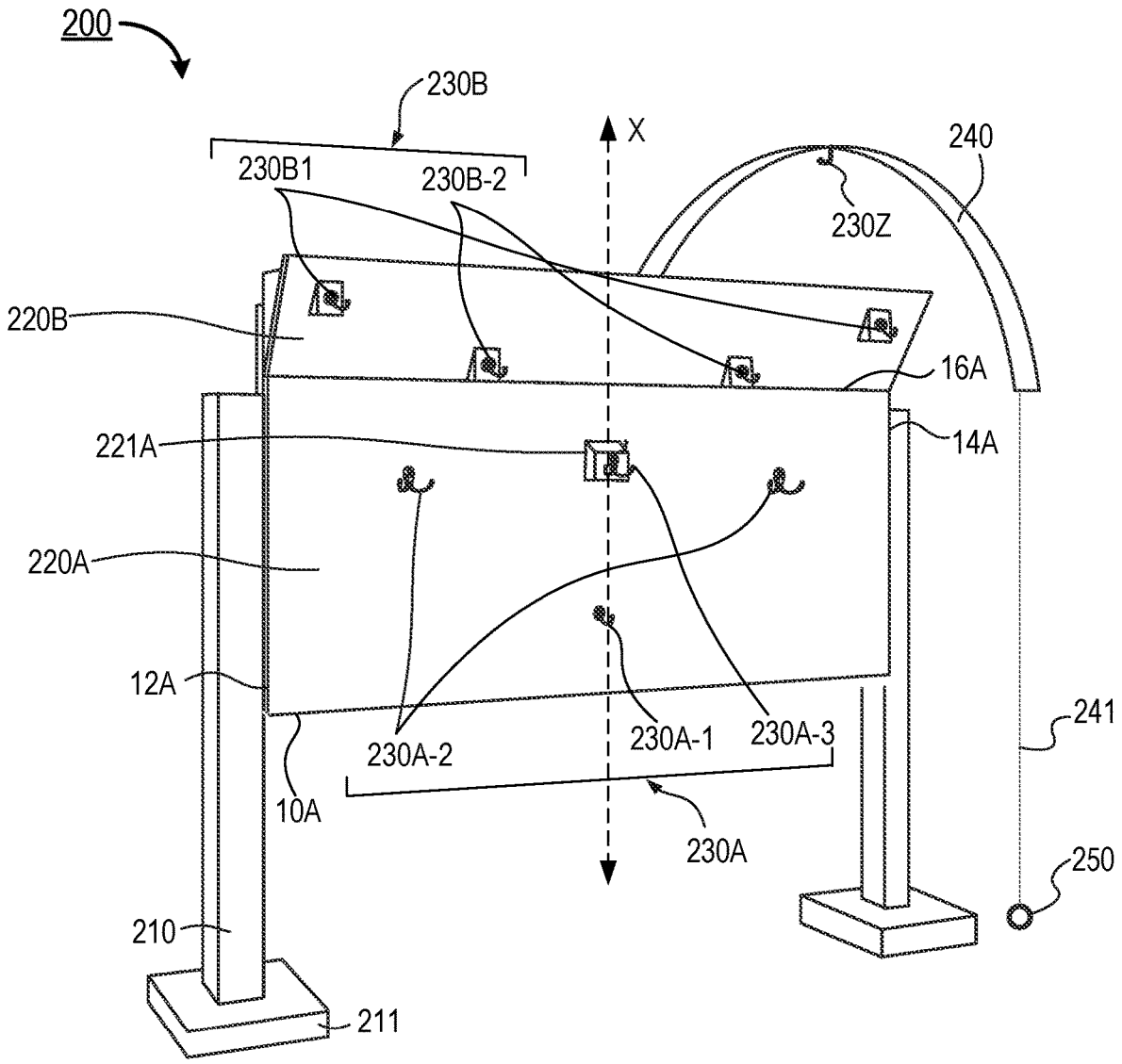
FIG. 2 is a perspective view schematic illustration of a game apparatus, according to an embodiment.
Figure 3:
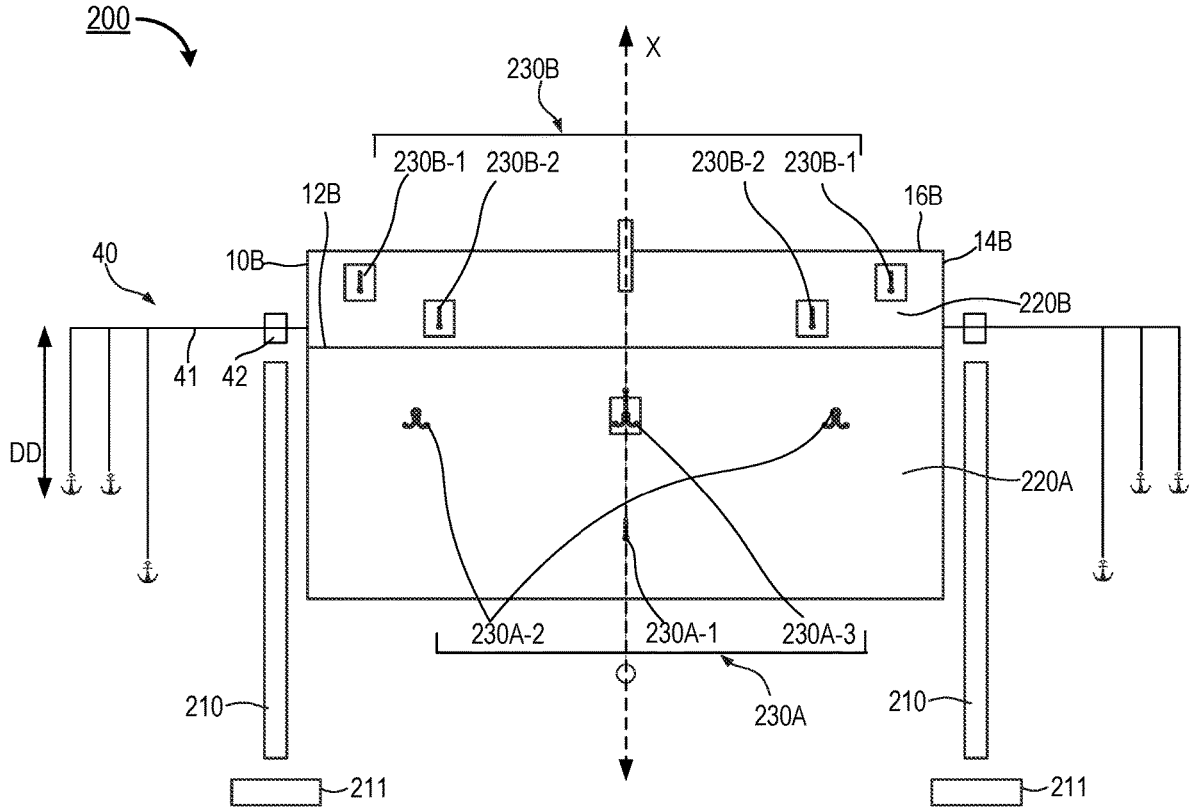
FIG. 3 is a front view schematic illustration of the game apparatus of FIG. 2.
Figure 4:
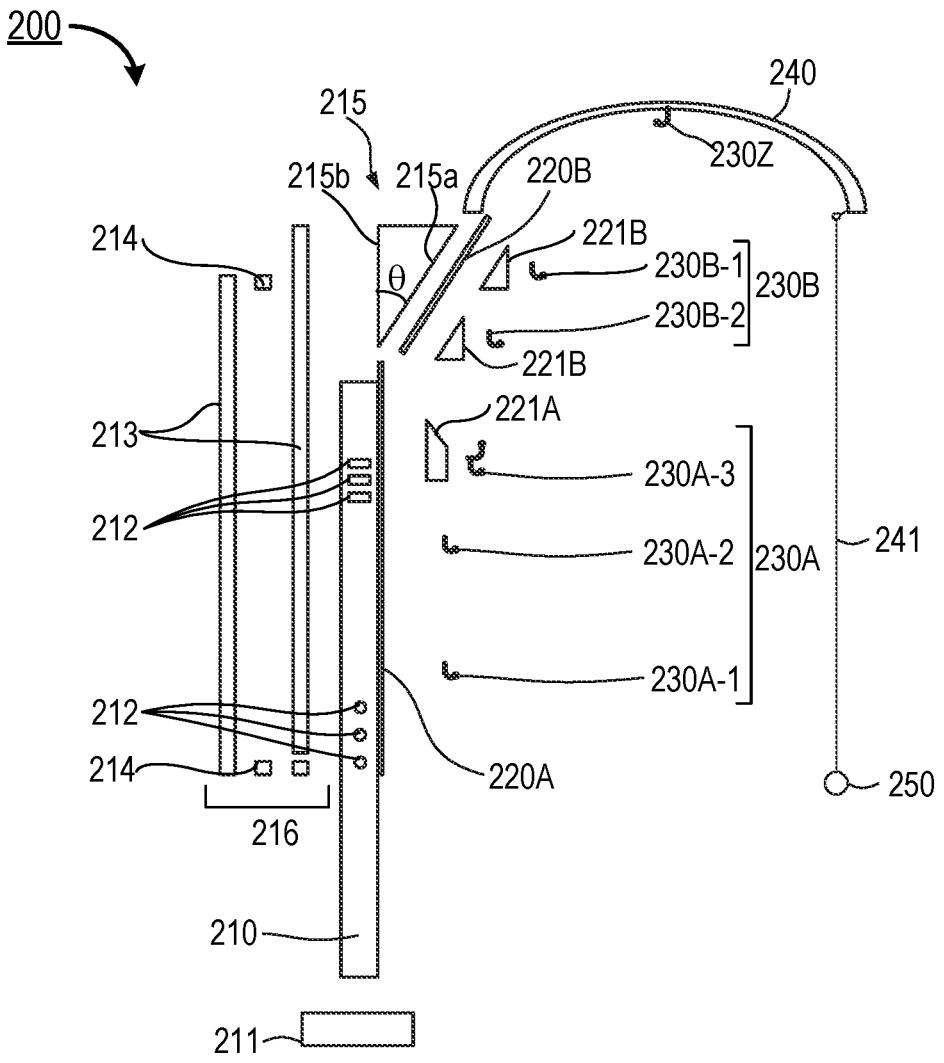
FIG. 4 is a side view schematic illustration of the game apparatus of FIG. 2.

FIGS. 2-9 illustrate a ring and hook game apparatus 200 according to another embodiment. The ring and hook apparatus 200 (also referred to herein as "game apparatus" or "apparatus") can be similar in form and/or function to the game apparatus 100 described above with reference to FIG. 1. Accordingly, the descriptions herein of any similar portions and/or aspects of the game apparatus 200 may not be described in further detail herein. The game apparatus 200 includes a support component 210, a first playing surface 220A, a second playing surface 220B, an anchoring component 240, and a ring 250. The support component 210 can include two support legs 210 coupled to the first playing surface 220A and the second playing surface 220B. The support legs 210 are configured to provide structural support to all the components of the game apparatus 200 including the first playing surface 220A, the second playing surface 220B, the anchoring component 240, and the ring 250, as shown in FIGS. 2, 4, and 3.

The first playing surface 220A defines a first plane that is oriented perpendicular with respect to a plane defined by the ground and/or floor where the game apparatus 200 is disposed on. As shown in FIGS. 2 and 3, the first playing surface 220A includes multiple hooks 230A (e.g., 203A-1, 230A-2, and 230A-3) disposed on the first playing surface 220A. The hooks 230A can be disposed on various regions, sectors, and/or portions of the first playing surface 220A to provide different levels of difficulty to a player when the player tosses the ring 250 to ensnare, couple, attach, and/or fasten the ring 250 to the hooks 230A, as further described herein. The second playing surface 220B defines a second plane. The second playing surface 220B is coupled to the first playing surface 220A oriented such that the first plane and the second plane define an angle "θ." Similar to the first playing surface 220A, the second playing surface 220B includes multiple hooks 230B (e.g., 230B-1 and 230B2) disposed on various regions, sectors, and/or portions of the second playing surface 220B, as shown in FIGS. 2 and 3. The hooks 230B can be configured to provide different levels of difficulty to a player when the player tosses the ring 250 to ensnare, couple, attach, and/or fasten the ring 250 to the hooks 230B, as further described herein. The anchoring component 240 includes a first end portion that is coupled to the support component 210 and/or to the second playing surface 220B, a hook 230Z disposed along the length of the anchoring component 240, and a second end portion from which the ring 250 is attached to via a string 241, as shown in FIG. 2.

FIG. 2 shows the support legs 210 can have a three-dimensional shape defined by a length and a rectangular cross-sectional area. Alternatively, in some embodiments the support legs 210 can have a three-dimensional shape defined by a length and any suitable cross-sectional area including for example, circular, oval, square, and/or other polygonal cross-sectional area. The length of the support legs 210 can have an impact on the relative position of the first playing surface 220A, and the second playing surface 220B with respect to the ground, which in turn can influence the amount of force, the angle, and the trajectory required to toss the ring 250 in order to ensnare, couple, attach, and/or fasten the ring to a hook 230 (e.g., a hook 230A and/or a hook 230B). In some embodiments, the length of the support legs 210 can be at least about 155 cm, at least about 170 cm, at least about 185 cm, at least about 200 cm, at least about 215 cm, at least about 230 cm, at least about 245 cm, at least about 280 cm, inclusive of all values and ranges therebetween. In some embodiments, the length of the support legs 210 can be no more than about 280 cm, no more than about 250 cm, no more than about 230 cm, no more than about 215 cm, no more than about 200 cm, no more than about 185 cm, no more than about 170 cm, no more than about 155 cm, inclusive of all values and ranges therebetween. Combinations of the above referenced ranges for the length of the support legs 210 are also possible (e.g., a length of at least about 155 cm to no more than about 213 cm, at least about 190 cm to no more than about 270 cm).

The support legs 210 can be removably couplable to the first playing surface 220A to adjust the height of the first playing surface 220A with respect to the ground. To that end, the support legs 210 can include multiple attachment points 212 (also referred to as height adjustment points 212) disposed along the length of the support legs 210. FIG. 4 shows each support leg 210 includes a set of height adjustment points 212 located on a surface of the support leg 210 which can be disposed adjacent to the first playing surface 220A such that a set of bolts, fasteners, nails, and/or screws can be received therein to couple the support leg 210 to the first playing surface 220A. FIG. 4 shows the support legs 210 includes a bottom set of height adjustment points 212 and a top set of height adjustment points 212 disposed on a side of the support leg 210. In some implementations the bottom set of height adjustment points 212 can include two, three or more height adjustment points 212 disposed along a line and within the bottom end-portion of the support leg 210 (e.g., the end-portion of the support leg 210 proximal to the base structure 211). Similarly, the top set of height adjustment points 212 can include two, three, or more height adjustment points 212 disposed along a line within the top end-portion of the support leg 210 (e.g., the end-portion of the support leg 210 distal to the base structure 211). Alternatively, in some embodiments the top and bottom height adjustment points 212 can be disposed on the support legs 210 following a pattern different from a straight line. In such embodiments, the positions of the height adjustment points 212 can be configured such that the first playing surface 220A can be oriented at different angles with respect to the ground and/or floor.

In use, a player can adjust the height and the angle of the first playing surface 220A with respect to the ground by selecting one bottom height adjustment point 212 and a corresponding top height adjustment point 212, and introducing a bolt, fastener, screw, rivet, anchor or any other coupling methods through the selected adjustment points 212. In some embodiments, the distance between adjacent height adjustment points 212 can be at least about 1 cm, at least about 2 cm, at least about 3 cm, at least about 4 cm, at least about 5 cm, at least about 6 cm, at least about 7 cm, inclusive of all values and ranges therebetween. In some embodiments, the distance between adjacent height adjustment points 212 can be at no more than about 7 cm, no more than about 6.5 cm, no more than about 5.5 cm, no more than about 4.5 cm, no more than about 3.5 cm, no more than about 2.5 cm, no more than about 1 cm, inclusive of all values and ranges therebetween. Combinations of the above referenced ranges for the distance between adjacent height adjustment points 212 are also possible (e.g., a distance of at least about 1.5 cm to no more than about 2.6 cm, at least about 3 cm to no more than about 6.5 cm).

FIGS. 2-4 show each support leg 210 can include a base structure 211 disposed on an end-portion of the leg 210, shaped as a rectangular and/or square piece, and sized such that the base structure 211 increases the contact area between the game apparatus 200 and the floor and/or the surface over which the game apparatus 200 is placed. Alternatively, in some embodiments the base structure 211 can be any suitable geometrical shape including circular, oval, polygonal or the like. The base structure 211 can be configured to improve the mechanical stability of the game apparatus 200, preventing the game apparatus 200 from tipping over and falling. In some embodiments, the base structure 211 can be a square shape defined by a side of at least about 25 cm, at least about 30 cm, at least about 35 cm, at least about 40 cm, at least about 45 cm, at least about 50 cm, at least about 60 cm, at least about 65 cm, inclusive of all values and ranges therebetween. In some embodiments the base structure 211 can be a square shape defined by a side of no more than about 65 cm, no more than about 60 cm, no more than about 55 cm, no more than about 50 cm, no more than about 45 cm, no more than about 40 cm, no more than about 35 cm, no more than about 30 cm, no more than about 25 cm, inclusive of all values and ranges therebetween. Combinations of the above referenced ranges for the length of the base structure 211 are also possible (e.g., a length of at least about 35 cm to no more than about 50 cm, at least about 45 cm to no more than about 60 cm).

The base structure 211 can be coupled to the support legs 210 using various coupling mechanisms including, but not limited to bolts, fasteners, nails, adhesives, welding, brazing or any combination thereof. In some embodiments the base structure 211 can be a pedestal-like shape (not shown) that includes a first portion including an opening configured to receive one end of a support leg 210, and a second portion adjacent to the first portion, and configured to increase the contact area between the support leg 210 and the ground to increase the stability of the game apparatus 200.

Figure 6:
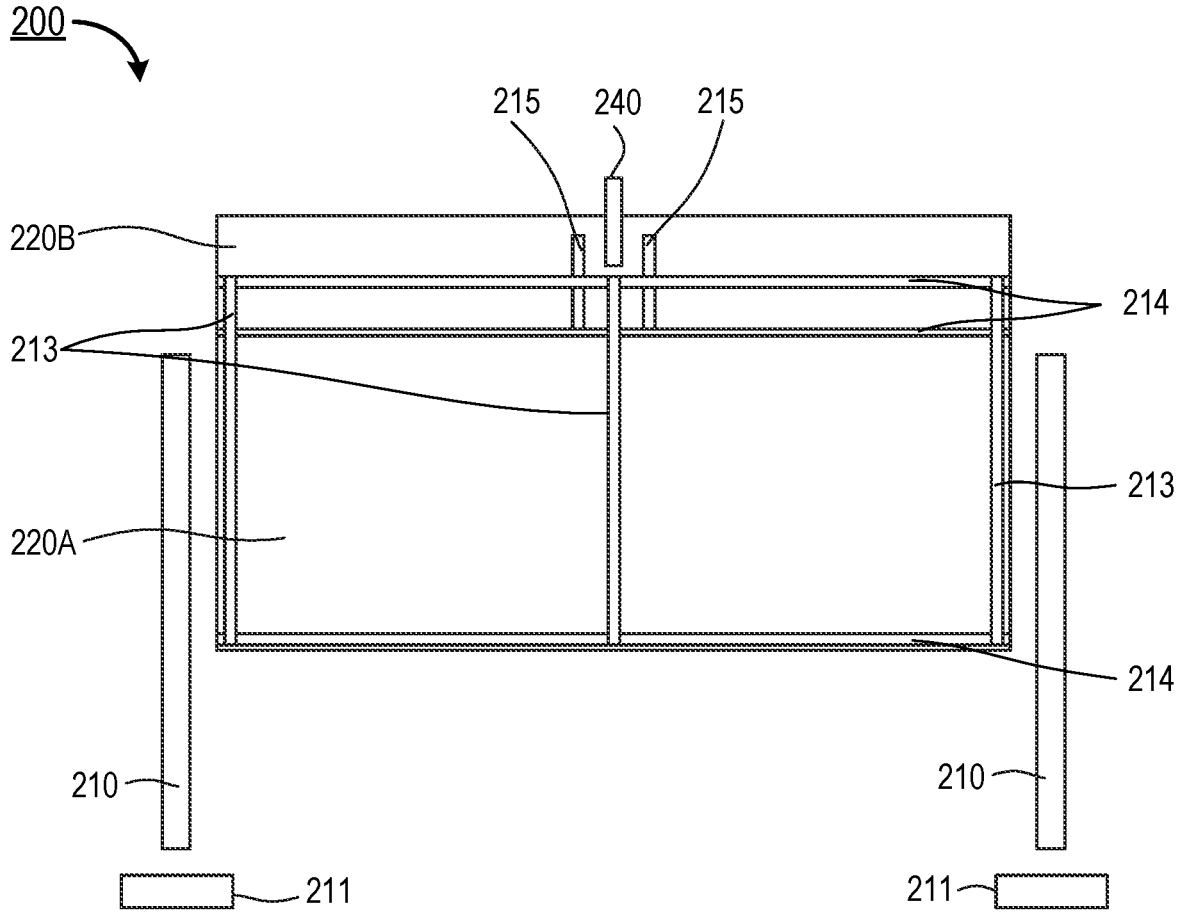
FIG. 6 is a rear-view schematic illustration of the game apparatus of FIG. 2.

FIGS. 4 and 6 show the support component 210 can also include a frame 216 configured to provide mechanical support to the first playing surface 220A, and/or other components of the game apparatus 200 such as the second playing surface 220B, the anchoring component 240, and the ring 250. The frame 216 can be formed of any number of struts, beams, plates, posts or a combination thereof, coupled together using various coupling mechanisms including, but not limited to bolts, nails, fasteners, welding, brazing, adhesives and the like. For example, as shown in FIG. 6, in some embodiments the frame 216 can include three vertical struts 213, and three horizontal struts 214. The vertical struts 213 can be mechanically coupled to (1) a surface of the first playing surface 220A opposite to the surface in which the hook(s) 230 are attached to (e.g., the back side of the first playing surface 220A) near the vertical edges, and/or (2) the support legs 210, as shown in FIG. 6. The horizontal struts 214 can be mechanically coupled to the back side of the first playing surface 220A near the horizontal edges, and/or to the back side of the second playing surface 220B near the horizontal edges, as shown in FIG. 6. In some embodiments, the vertical struts 213 can include one or more vertical strut(s) 213 coupled to the back side of the first playing surface 220A at different positions including for example, along the vertical axis X that divides the first playing surface 220A in two equally sized halves, as shown in FIG. 6. The vertical struts 213, the horizontal struts 214 can collectively define the frame 216 and provide the required rigidity to the first playing surface 220A and/or the second playing surface 220B. The components of the frame 216, including the vertical struts 213, and the horizontal struts 214 can be made of any suitable material including, for example, aluminum, steel, stainless steel, bronze, wood, polyethylene (PE), high density polyethylene (HDPE), Polypropylene (PP), polystyrene (PS), polyvinyl chloride (PVC) and the like, or any combination thereof.

FIGS. 2-4 and 6 show the first playing surface 220A can be a substantially flat and/or planar board and/or panel that defines a first plane and provides a surface over which multiple hooks 230A can be attached. The first playing surface 220A can be coupled to the support legs 210 via the height adjustment points 212, in such a way that the first plane defined by the first playing surface 220A assumes an orientation perpendicular to the ground and/or floor on which the game apparatus 200 is being disposed on. Alternatively, in some embodiments the first playing surface 220A can be coupled to the support legs 210 in such way that the first playing surface 220A defines a first plane that forms and/or defines an angle (different from 90 degrees) with the ground and/or floor over which the apparatus 200 is disposed on. FIG. 3 shows the first playing surface 220A can have a shape defined by a rectangular cross-sectional of a given width and height. The width and the height of the rectangular cross-sectional area of the first playing surface 220A can be any suitable magnitude. For example, in some embodiments the width of the cross-sectional area of the first playing surface 220A can be at least about 130 cm, at least about 140 cm, at least about 150 cm, at least about 160 cm, at least about 170 cm, at least about 180 cm, at least about 200 cm, at least about 230 cm, at least about 250 cm, inclusive of all values and ranges therebetween. In some embodiments the width of the cross-sectional area of the first playing surface 220A can be no more than about 250 cm, no more than about 225 cm, no more than about 200 cm, no more than about 175 cm, no more than about 150 cm, no more than about 135 cm, no more than about 120 cm, inclusive of all values and ranges therebetween. Combinations of the above referenced ranges for the width of the cross-sectional area of the first playing surface 220A are also possible (e.g., a width of at least about 145 cm to no more than about 213 cm, at least about 152 cm to no more than about 230 cm).

In some embodiments the height of the cross-sectional area of the first playing surface 220A can be at least about 60 cm, at least about 70 cm, at least about 80 cm, at least about 90 cm, at least about 100 cm, at least about 110 cm, at least about 120 cm, at least about 130 cm, at least about 160 cm, inclusive of all values and ranges therebetween. In some embodiments the height of the cross-sectional area of the first playing surface 220A can be no more than about 160 cm, no more than about 145 cm, no more than about 130 cm, no more than about 115 cm, no more than about 100 cm, no more than about 85 cm, no more than about 60 cm, inclusive of all values and ranges therebetween. Combinations of the above referenced ranges for the height of the cross-sectional area of the first playing surface 220A are also possible (e.g., a height of at least about 70 cm to no more than about 120 cm, at least about 90 cm to no more than about 115 cm).

FIGS. 2 and 3 show the first playing surface 220A can include one or more hooks 230A (e.g., 230A-1, 230A-2, and 230A-3) disposed on different regions and/or portions of the playing surface 220A. Similarly, FIGS. 2 and 3 also show the second playing surface 220B can include one or more hooks 230B (e.g., 230B-1 and 230B-2) disposed on different regions and/or portions of the playing surface 220B. The hook(s) 230A and the hook(s) 230B, which can be collectively referred to herein as "the hook(s) 230," can be substantially similar to the hook(s) 130 described above with reference to the playing apparatus 100. For example, the hook(s) 230 can be attached and/or coupled by any suitable means to a playing surface 220 (e.g., one or more hooks 230A can be coupled to the first playing surface 220A, and one or more hooks 230B can be coupled to the second playing surface 220B). The hook(s) 230 can be any suitable type of hook including, but not limited to, screw-in hook(s), magnet mounted hook(s), under-mount hook(s), vacuum hook(s), or any combination thereof. The hook(s) 230 can be made of any suitable material including metals such as aluminum, copper, steel, stainless steel, brass, bronze, zinc, polymeric materials such as nylon, polyamide, polycarbonate, polyester, polyethylene, polypropylene, PVC, and/or other materials including wood, and/or rubber. The hook(s) 230 can be any suitable shape and/or size. For example, in some embodiments the hook(s) 230 can be a J-shape hook, a circle shape hook, an offset hook, a non-offset hook, or the like.

Figure 5A:
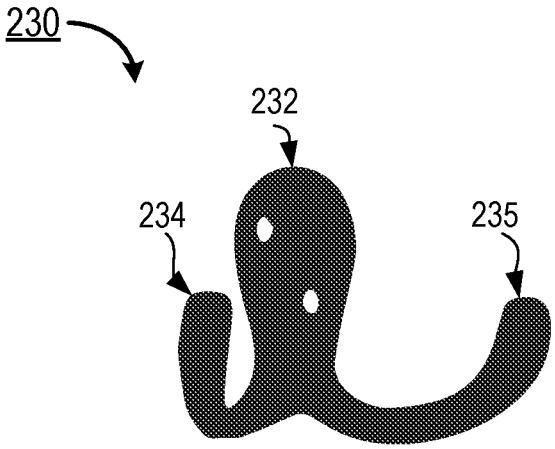
FIGS. 5A-5B are perspective view illustrations of hooks included in the playing surfaces of the game apparatus of FIG. 2.
Figure 5B:
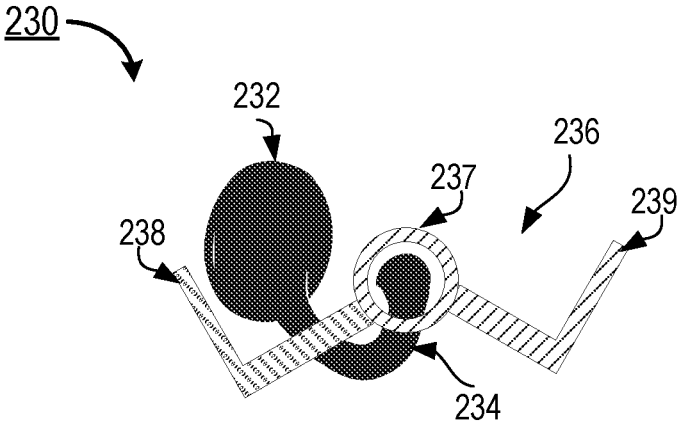

The hook(s) 230 can include multiple components including a base, and one or more shanks. For example, FIG. 5A shows in some embodiments the hook(s) 230 can include a base 232, a first shank 234, and a second shank 235. In other embodiments, as shown in FIG. 5B, the hook(s) 230 can include a base 232 and a single shank 234. In some embodiments, the hook(s) 230 can include an optional removably couplable hook-extender component 236. The optional hook-extender component 236 can be configured to extend the total number of shanks, also referred to herein as extension shanks, available for ensnaring, coupling, attaching, and/or fastening the ring 250. For example, as shown in FIG. 5B, the hook(s) 230 can be coupled to a hook-extender component 236 that includes an eye 237, a first extension shank 238, and a second extension shank 239. The hook-extender component 236 can be coupled to the hook(s) 230 by introducing the shank 234 of the hooks(s) 230 through the eye. The eye 237 of the hook-extender component 236 can be sized and shaped such that a primary shank 234 of the hook(s) 230 can be introduced through the eye 237 to secure the hook-extender component 236 to the hook(s) 230. In some embodiments, the hook-extender component 236 can include any suitable coupling mechanism to removably couple the hook-extender component 236 to the hook(s) 230. For example, in some embodiments the hook-extender component 236 can include a magnet, a latch, a string, an adhesive, or the like configured to be coupled to the base and/or a shank of the hook(s) 230. The hook(s) 230 when coupled with the hook-extender component 236 can offer multiple shanks, (e.g., the shank 234, the first extension shank 238, and the second extension shank 239) with each shank being disposed on the playing surface 220 at a specific orientation (e.g., an orientation with respect to the playing surface 220 and/or a position from which the ring 250 is typically tossed from). The availability of multiple shanks disposed in different orientations on the hook(s) 230 can facilitate attaching the ring 250 to the hook(s) 230 when a user tosses the ring 250. Consequently, coupling the hook-extender component 236 to the hook(s) 230 can reduce the level of difficulty for a player to toss the ring 250 and successfully attaching the ring 250 to the hook(s) 230.

The hook(s) 230 can be disposed and/or positioned at any suitable section and/or portion of the playing surfaces 220 with the purpose of providing different levels of difficulty for the ring 250 to be ensnared, coupled, attached, and/or fastened to the hook(s) 230. In some embodiments, one or more hook(s) 230 can be coupled directly to a playing surface 220 (e.g., the first playing surface 220A or the second playing surface 220B) such that the base 232 of the hook(s) 230 is disposed on the plane defined by the playing surface 220 (e.g., the first plane) or the second plane defined by the second playing surface. In other embodiments, one or more hooks 230 can be coupled to a platform 221 (e.g., platform 221A and platform 221B shown in FIG. 4) which is coupled to the playing surface 220. In such embodiments, the base of the hook(s) 230 is disposed on a plane parallel to the plane defined by the playing surface 220, which can increase the difficulty of tossing the ring 250 to attach the ring 250 to that particular hook(s) 230. For example, as shown in FIG. 2-4, the hook 230A-3 can be coupled to the platform 221A such that the base 232 of the hook 230A-3 is disposed on a plane parallel to the plane defined by the first playing surface 220A.

As shown in FIG. 2, the first playing surface 220A can include multiple hook(s) 230A, including a bottom hook 230A-1, two side-hooks 230A-2, and a center hook 230A-3. The bottom hook 230A-1, the side-hooks 230A-2, and the center hook 230A-3 can be disposed on portions and/or sections of the first playing surface 220A defined with respect to a vertical axis X that divides the first playing surface 220A in two equal size sides, portions and/or halves (e.g., a first side or left half side and a second side or right half side). For example, in some embodiments, the hook(s) 230 can include a bottom hook 230A-1 disposed on a central portion, region, and/or section of the first playing surface 220A along the vertical axis X of the first playing surface 220A. In some embodiments, the bottom hook 230A-1 can be disposed on a central portion, region, and/or section of the first playing surface 220A and at a short distance from the horizontal edge of the first playing surface 220A which is closer to the ground and/or floor (e.g., the lower horizontal edge 10A), as shown in FIG. 2.

In some embodiments, the distance between the position of the bottom hook 230A-1 and the lower horizontal edge 10A of the first playing surface 220A can be at least about 10 cm, at least about 15 cm, at least about 18 cm, at least about 20 cm, at least about 22 cm, at least about 24 cm, at least about 30 cm, at least about 35 cm, inclusive of all values and ranges therebetween. In some embodiments, the distance between the position of the bottom hook 230A-1 and the lower horizontal edge 10A of the first playing surface 220A can be no more than about 35 cm, no more than about 30 cm, no more than about 25 cm, no more than about 20 cm, no more than about 15 cm, no more than about 15 cm, inclusive of all values and ranges therebetween. Combinations of the above referenced ranges for the distance between the position of the bottom hook 230A-1 and the lower horizontal edge 10A of the first playing surface 220A are also possible (e.g., a distance of at least about 15 cm to no more than about 23 cm, at least about 19 cm to no more than about 27 cm).

In some embodiments the hook(s) 230A can include two side-hooks 230A-2. The side-hooks 230A-2 can be symmetrically positioned on the first playing surface 220A. That is, a first side-hook 230A-2 can be disposed on a first side (e.g., a left-side), portion, and/or region of the first playing surface 220A, and a second side-hook 230A-2 can be disposed on a second side, (e.g., a right side), portion, and/or region of the first playing surface 220A opposite to the first side, with the left-side portion and the right-side portion of the first playing surface 220A being defined with respect to the vertical axis X of the first playing surface 220A. FIG. 2 shows each side-hook 230A-2 can be disposed at a position that is (1) a short distance from the vertical edges of the first playing surface 220A (e.g., the left vertical edge 12A for the side-hook disposed on the left-side portion of the first playing surface 220A, and the right vertical edge 14A for the side-hook disposed on the right-side portion of the first playing surface 220A, and (2) a short distance from upper horizontal edge 16A of the first playing surface 220A. In some embodiments, the distance between the position where each side-hook 230A-2 is disposed and its nearest vertical edge of the first playing surface 220A (e.g., vertical edges 12A or 14A) can be at least about 10 cm, at least about 15 cm, at least about 20 cm, at least about 25 cm, at least about 30 cm, at least about 35 cm, at least about 40 cm, inclusive of all values and ranges therebetween. In some embodiments, the distance between the position where each side-hooks 230A-2 is located and its nearest vertical edge of the first playing surface 220A (e.g., vertical edges 12A or 14A)

can be no more than about 40 cm, no more than about 36 cm, no more than about 32 cm, no more than about 28 cm, no more than about 24 cm, no more than about 20 cm, no more than about 16 cm, no more than about 10 cm, inclusive of all values and ranges therebetween. Combinations of the above referenced ranges for the distance between the position where each side-hook 230A-2 is disposed and its nearest vertical edge of the first playing surface 220A (e.g., vertical edge 12A or 14A) are also possible (e.g., a distance of at least about 18 cm to no more than about 30 cm, at least about 28 cm to no more than about 35 cm)

In some embodiments, the distance between the positions where the side-hooks 230A-2 are disposed and the upper horizontal edge 16A of the first playing surface 220A can be at least about 18 cm, at least about 21 cm, at least about 24 cm, at least about 28 cm, at least about 32 cm, at least about 36 cm, at least about 40 cm, inclusive of all values and ranges therebetween. In some embodiments, the distance between the positions where the side-hooks 230A-2 are disposed and the upper horizontal edge 16A of the first playing surface 220A can be no more than about 40 cm, no more than about 35 cm, no more than about 30 cm, no more than about 25 cm, no more than about 20 cm, no more than about 18 cm, inclusive of all values and ranges therebetween. Combinations of the above referenced ranges for the distance between the positions where the side-hooks 230A-2 are located and the upper horizontal edge 16A of the first playing surface 220A are also possible (e.g., a distance of at least about 21 cm to no more than about 28 cm, at least about 24 cm to no more than about 37 cm).

In some embodiments the hooks 230A can include a center hook 230A-3 disposed on a central region and/or portion of the first playing surface 220A. As described above, in some embodiments the center hook 230A-3 can be coupled directly to the first playing surface 220A, while in other embodiments, the center hook 230A-3 can be coupled to a platform 221A disposed on the playing surface 220A, as shown in FIG. 2. The hook 230A-3 can be disposed on the platform 221A such that the base 232 of the hook 230A-3 is disposed on a plane different from but parallel to the first plane defined by the first playing surface 220A. The plane defined by the platform 221A can modify the level of difficulty of tossing the ring 250 to attach the ring 250 to the hook 230A-3. In some embodiments, the central hook 23A-3 can be disposed on a central region and/or portion of the playing surface 220A (on the platform 221A) at a position along the vertical axis X and at a short distance of the upper edge 16A of the first playing surface 220A, as shown in FIGS. 2 and 3. The platform 221A can be any suitable shape and size. For example, in some embodiments the platform 221A can be a three-dimensional shape defined by a length and any suitable cross-sectional area including circular, oval, square, rectangular, and/or other polygonal cross-sectional area. The platform 221A can be coupled to the first playing surface 220A by any suitable coupling mechanism including bolts, fasteners, nails, adhesives, welding, brazing or any combination thereof. In some embodiments the platform 221A can be made of the same material as the first playing surface 220A. In other embodiments, the platform 221A can be made of one or more materials including wood, polyethylene (PE), high density polyethylene (HDPE), Polypropylene (PP), polystyrene (PS), polyvinyl chloride (PVC), Aluminum, Steel, stainless steel, polycarbonates ceramic materials, and/or the like.

The center hook 230A-3 and/or the platform 221A can be disposed on a central portion and/or section of first playing surface 220A (e.g., a point located on the vertical axis X that divides the first playing surface 220A in two equal size portions and/or halves), and at a short distance from the upper horizontal edge 16A of the playing surface 220A. In some embodiments, the distance between the position of the center hook 230A-3 and/or the platform 221A and the upper horizontal edge 16A of the first playing surface 220A can be at least about 10 cm, at least about 15 cm, at least about 18 cm, at least about 20 cm, at least about 22 cm, at least about 24 cm, at least about 30 cm, at least about 35 cm, inclusive of all values and ranges therebetween. In some embodiments, the distance between the position of the center hook 230A-3 and/or the platform 221A and the upper horizontal edge 16A of the first playing surface 220A can be no more than about 35 cm, no more than about 30 cm, no more than about 25 cm, no more than about 20 cm, no more than about 15 cm, no more than about 15 cm, inclusive of all values and ranges therebetween. Combinations of the above referenced ranges for the distance between the position of the center hook 230A-3 and/or platform 221A and the upper horizontal edge 16A of the first playing surface 220A are also possible (e.g., a distance of at least about 15 cm to no more than about 23 cm, at least about 19 cm to no more than about 27 cm).

FIGS. 2-4 and 6 show the second playing surface 220B can be a substantially flat and/or planar board and/or panel that provides a surface over which multiple hooks 230B can be attached. The second playing surface 220B can be similar to and/or substantially the same as one or more portions (and/or combination of portions) of the first playing surface 220A. As such, portions and/or components of the second playing surface 220B may not be described in further detail herein. FIGS. 2 and 3 show the second playing surface 220B can have a shape defined by a rectangular cross-sectional area of a given width and height. The width of the rectangular cross-sectional area of the second playing surface 220B can be substantially similar and/or the same as the width of the first playing surface 220A, as shown in FIG. 3. Alternatively, in some embodiments the width of the rectangular cross-sectional area of the second playing surface 220B can be different from the width of the first playing surface 220A. The height of the second playing surface 220B can be any suitable magnitude. For example, in some embodiments the height of the second playing surface 220B can be at least about 25 cm, at least about 30 cm, at least about 35 cm, at least about 40 cm, at least about 50 cm, at least about 60 cm, inclusive of all values and ranges therebetween. In some embodiments the height of the second playing surface 220B can be no more than about 60 cm, no more than about 55 cm, no more than about 45 cm, no more than about 35 cm, no more than about 25 cm, no more than about 20 cm, inclusive of all values and ranges therebetween. Combinations of the above referenced ranges for the height of the second playing surface 220B are also possible (e.g., a height of at least about 25 cm to no more than about 31 cm, at least about 28 cm to no more than about 59 cm).

The second playing surface 220B can be coupled to the first playing surface 220A and/or a component thereof such that the second playing surface 220B is disposed adjacent to the first playing surface 220A. FIGS. 4 and 6 show that the second playing surface 220B can be coupled to the frame 216 (e.g., coupled to the vertical struts 213 and the horizontal struts 214). The second playing surface 220B can be coupled to the vertical struts 213 in such a way that a horizontal edge of the second playing surface 220B is disposed adjacent to the upper horizontal edge 16A of the playing surface 220A, as shown in FIG. 2. Moreover, the second playing surface 220B can be coupled to the first playing surface 220A at a predetermined orientation defined by the angle "θ" shown in FIG. 4. The second playing surface 220B can be coupled to the first playing surface 220A at the predetermined orientation defined by the angle "θ" with the aid of one or more orientation components 215. FIG. 4 shows the orientation component 215 can be one or more brackets 215 having a triangular shape (e.g., triangular brackets). A first side 215*a* of the triangular brackets 215 can define a first surface that can be coupled and/or attached to the second playing surface 220B. A second side 215*b* of the triangular brackets 215 can define a second surface that can be coupled to the vertical struts 213 to secure the second playing surface 220B to the game apparatus 200, oriented at the angle "θ" with respect to the first playing surface 220A. The angle "θ" can be defined by the ratio of the first side 215*a* to the second side 215*b* (e.g., 215*a*/215*b*).

The angle "θ" that defines the orientation of the second playing surface 220B with respect to the first playing surface 220A can assume any suitable value. For example, in some embodiments the angle "θ" can be at least about 30°, at least about 35°, at least about 40°, at least about 45°, at least about 50°, at least about 55°, at least about 60°, at least about 65°, inclusive of all values and ranges therebetween. In some embodiments the angle "θ" can be no more than about 65°, no more than about 60°, no more than about 56°, no more than about 65°, no more than about 58°, no more than about 54°, no more than about 50°, no more than about 46°, no more than about 42°, no more than about 38°, no more than about 34°, no more than about 30°, inclusive of all values and ranges therebetween. Combinations of the above referenced ranges for the angle "θ" are also possible (e.g., an angle "θ" of at least about 38° to no more than about 60°, at least about 55° to no more than about 65°).

The second playing surface 220B and the orientation component 215 can be made of any suitable material including, but not limited to wood, polyethylene (PE), high density polyethylene (HDPE), Polypropylene (PP), polystyrene (PS), polyvinyl chloride (PVC), Aluminum, Steel, stainless steel, polycarbonates and/or the like. In some embodiments the second playing surface 220B can include multiple panels of similar same cross-sectional area stacked together to produce a thick structure that exhibits sufficient rigidity to support the weight of the hooks attached to the second playing surface 220B and prevent deformation of the substantially flat cross-sectional area defined by the second playing surface 220B (e.g., prevents the second playing surface 220B from warping.

FIGS. 2 and 3 show the second playing surface 220B can include multiple hooks 230B. The hooks 230B can be attached and/or coupled to the second playing surface 220B by any suitable means. For example, in some embodiments the hooks 230B can be screw-in hooks, magnet mounted hooks, under-mount hooks, vacuum hooks, or the like. The hooks 230B can be similar to and/or substantially the same as one or more portions (and/or combination of portions) of the hooks 230A described above with reference to the first playing surface 220A. As such, portions and/or components of the hooks 230B may not be described in further detail herein. The hooks 230B can be disposed and/or positioned at any suitable section and/or portion of the second playing surface 220B with the purpose of providing different levels of difficulty for the ring to be ensnared, coupled, attached, and/or fastened to the hook. In some embodiments the second playing surface 220B can include two exterior hooks 230B-1 and two interior hooks 230B-2 disposed on the substantially flat area defined by the second playing surface 220B, as shown in FIGS. 2 and 3.

The two interior hooks 230B-2 can be symmetrically positioned on the second playing surface 220B at a short distance from the horizontal edge of the second playing surface 220B adjacent to the first playing surface 220A (e.g., the lower horizontal edge 12B) shown in FIG. 2. A first interior hook 230B-2 can be disposed on a left-side portion of the second playing surface 220B, and a second interior hook 230B-2 can be disposed on the right-side portion of the second playing surface 220B, with the left-side portion and the right-side portion of the second playing surface 220B being defined with respect to the vertical axis X shown in FIGS. 2 and 3. FIG. 3 shows each interior hook 230B-2 can be disposed on the second playing surface 220B at a position located at a first distance from a vertical edge of the second playing surface 220B (e.g., the left vertical edge 10B for the interior hook 230B-2 disposed on the left-side portion of the second playing surface 220B, and the right vertical edge 14B for the interior hook 230B-2 disposed on the right-side portion of the second playing surface 220B). Similarly, the interior hooks 230B-2 can be disposed on the second playing surface 220B at a position located at a second distance from the lower horizontal edge 12B of the second playing surface 220B. In some embodiments, the first distance (e.g., the distance between the position of an interior hook 230B-2 and its nearest vertical edge of the second playing surface 220B) can be at least about 28 cm, at least about 32 cm, at least about 36 cm, at least about 40 cm, at least about 44 cm, at least about 48 cm, at least about 52 cm, least about 60 cm, inclusive of all values and ranges therebetween. In some embodiments, the first distance can be no more than about 60 cm, no more than about 55 cm, no more than about 50 cm, no more than about 45 cm, no more than about 40 cm, no more than about 35 cm, no more than about 30 cm, no more than about 28 cm, inclusive of all values and ranges therebetween. Combinations of the above referenced ranges for the first distance are also possible (e.g., a distance of at least about 28 cm to no more than about 44 cm, at least about 36 cm to no more than about 58 cm).

In some embodiments, the second distance (e.g., the distance between the position of an interior hook 230B-2 and the lower horizontal edge 12B of the second playing surface 220B) can be at least about 0.4 cm, can be at least about 0.6 cm, can be at least about 0.8 cm, can be at least about 1.0 cm, can be at least about 2 cm, can be at least about 3 cm, can be at least about 5 cm, inclusive of all values and ranges therebetween. In some embodiments the second distance can be no more than about 6 cm, can be no more than about 5 cm, can be no more than about 4 cm, can be no more than about 3 cm, can be no more than about 2 cm, can be no more than about 1 cm, can be no more than about 0.8 cm, can be no more than about 0.4 cm, inclusive of all values and ranges therebetween. Combinations of the above referenced ranges for the second distance are also possible (e.g., a distance of at least about 0.6 cm to no more than about 4 cm, at least about 1 cm to no more than about 6 cm).

The hooks 230B can also include two exterior hooks 230B-1 symmetrically positioned on the second playing surface 220B at a short distance from the upper horizontal edge 16B of the second playing surface 220B, as shown in FIG. 3. Similar to the interior hooks 230B-2, a first exterior hook 230B-1 can be disposed on a left-side portion of the second playing surface 220B, and a second exterior hook 230B-1 can be disposed on the right-side portion of the second playing surface 220B, with the left-side portion and the right-side portion of the second playing surface 220B being defined with respect to the vertical axis X shown in FIGS. 2 and 3. FIG. 3 shows each exterior hook 230B-1 can be disposed on the second playing surface 220B at a position located at a first distance from a vertical edge of the second playing surface 220B (e.g., the left vertical edge 10B for the exterior hook 230B-1 disposed on the left-side portion of the second playing surface 220B, and the right vertical edge 14B for the exterior hook 230B-1 disposed on the right-side portion of the second playing surface 220B). The exterior hooks 230B-1 can also be disposed on the second playing surface 220B at a second distance from upper horizontal edge 16B of the second playing surface 220B. In some embodiments, the first distance (e.g., the distance between the position of an exterior hook 230B-1 and its nearest vertical edge of the second playing surface 220B) can be at least about 1 cm, at least about 2 cm, at least about 3 cm, at least about 4 cm, at least about 5 cm, at least about 6 cm, at least about 7 cm, least about 8 cm, inclusive of all values and ranges therebetween. In some embodiments, the first distance can be no more than about 6 cm, no more than about 5.5 cm, no more than about 4.5 cm, no more than about 3.5 cm, no more than about 2.5 cm, no more than about 1.5 cm, no more than about 1 cm, inclusive of all values and ranges therebetween. Combinations of the above referenced ranges for the first distance are also possible (e.g., a distance of at least about 1 cm to no more than about 4 cm, at least about 3.8 cm to no more than about 5.8 cm).

In some embodiments, the second distance (e.g., the distance between the position of an exterior hook 230B-1 and the upper horizontal edge 16B of the second playing surface 220B) can be at least about 1 cm, at least about 2 cm, at least about 3 cm, at least about 4 cm, at least about 5 cm, at least about 6 cm, at least about 7 cm, least about 8 cm, inclusive of all values and ranges therebetween. In some the second distance can be no more than about 6 cm, no more than about 5.5 cm, no more than about 4.5 cm, no more than about 3.5 cm, no more than about 2.5 cm, no more than about 1.5 cm, no more than about 1 cm, inclusive of all values and ranges therebetween. Combinations of the above referenced ranges for the second distance are also possible (e.g., a distance of at least about 1 cm to no more than about 4 cm, at least about 3.8 cm to no more than about 5.8 cm).

FIG. 3 shows in some embodiments the second playing surface 220B can include a rotating mechanism 40 configured to change the orientation of the interior hook(s) 230B-2 and/or the exterior hook(s) 230B-1 with respect to the second playing surface 220B. The rotating mechanism 40 can change the orientation of one or more hook(s) 230B (e.g., one or more interior hook(s) 230B-2 and/or one or more exterior hook(s) 230B-1) to facilitate decoupling the ring 250 when the ring 250 is successfully attached to the hooks 230B. For example, in some embodiments, the rotating mechanism 40 can include a pulley (not shown), a rope 41, and one or more rotating plates 42 coupled to and/or otherwise configured to engage one or more hooks 230B (e.g., the interior hooks 230B-2 and/or the exterior hooks 230B-1). As shown in FIG. 3, the rotating mechanism 40 can be activated by manually pulling the rope 41 in a direction DD. The rope 41 can cause the rotating plates 42 to rotate along an axis perpendicular to the playing surface 220B in a clockwise or counterclockwise direction up to 360 degrees. As described above, the rotating plates 42 can be coupled to one or more hooks 230B such that the rotation of the rotating plates 42 can cause rotation of the hooks 230B coupled to the rotating plates 42 along the axis perpendicular to the playing surface 220B. The rotation of the hooks 230B changes the orientation of the shank(s) of the hooks 230B with respect to the ground and/or floor where the apparatus 200 is disposed (e.g., inverting the shank(s) of the hooks 230B upside down), facilitating decoupling and/or releasing the ring 250 from the hook(s) when the ring 250 is attached to the hooks 230B. In some embodiments the rotating mechanism 40 can include multiple rotating plates 42 coupled to one or more hooks 230 (e.g., hook(s) 230A, and/or hook(s) 230B) which are disposed on a portion and/or region of a playing surfaces 220 that is difficult to reach by a player and/or user of the game apparatus 200. For example, in some embodiments, one or more hook(s) 230 can be disposed on the playing surface 220 at a distance from the ground that greatly exceeds the height of a player and/or user of the game apparatus 200. When the player and/or user successfully attaches the ring 250 to one of those hooks 230, the player and/or user cannot easily reach the hook 230 to release the ring 250 and continue playing. To facilitate the release of the ring 250 the player and/or user can use the rotating mechanism 40 and pull the ropes 41 to activate the rotating plates 42 and thus change the orientation and/or inverting one or more hooks 230 (including the hook 230 which has the ring 250 attached to it) to facilitate release of the ring 250.

The anchoring component 240 is an elongated structure configured to provide an anchoring point from which the ring 250 can be suspended from. FIG. 6 shows the anchoring component 240 can be coupled to the back side of the second playing surface 220B. The anchoring component 240 can be coupled to the second playing surface 220B by any suitable coupling mechanism including bolts, fasteners, nails, adhesives, welding, brazing or any combination thereof. Alternatively, in some embodiments the anchoring component 240 can be coupled to the support component 210 by any suitable means. FIG. 4 shows the anchoring component 240 can be cantilevered to a horizontal edge of the second playing surface 220B such that a first end-portion of the anchoring component 240 is mechanically coupled to the second playing surface 220B and the second end-portion of the anchoring component 240 extends away from the second playing surface 220B. The second-end portion of the anchoring component 240 can be coupled to a string 241 from which the ring 250 can be suspended from. In some embodiments the anchoring component 240 can be a plate defined by a length and rectangular cross-sectional. Alternatively, in other embodiments the anchoring component 240 can be a rod, bar, pole, shaft, strut and the like. FIG. 4 shows in some embodiments the length of the anchoring component 240 can have a curvature (e.g., an arched shape). Alternatively, in other embodiments the length of the anchoring component 240 can be straight (e.g., a straight line), zigzagging, and/or any other suitable curvature. The anchoring component 240 includes a hook 230Z disposed at a distance that corresponds to the midpoint between the two ends of the anchoring component 240, as shown in FIGS. 2 and 4. Alternatively, in some embodiments, the hook 230Z can disposed at any suitable position along the length of the anchoring component 240. The hook 230Z can be similar to the hooks 230A, and 230B described above with respect to the first playing surface 220A and the second playing surface 220B, respectively. Accordingly, the hooks 230Z will not be further described herein FIG. 2 shows the anchoring component 240 includes a string 241 having one end attached to the anchoring component 240 at a position distal from the game apparatus 200, and the other end being attached and/or fastened to the ring 250. The string 241 can be configured to facilitate a player to toss the ring 250 towards the playing surfaces 220 (e.g., the first playing surface 220A and/or the second playing surface 220B) of the game apparatus 200 such that the ring 250 traverses from the hand of the player to the playing surfaces of the game apparatus 200 attached to the anchoring component 240 from the string 241. In some instances, the string 241 can facilitate tossing the ring 250 in a pendulum-like trajectory (e.g., a direct path throw) starting from the hand of a player and ending on a hook of a playing surface 220 in an effort to ensnare, couple, attach, and/or fasten the ring 250 to a hook 230 of the game apparatus 200. In other instances, the string 241 can facilitate tossing the ring 250 according to a multi-step trajectory in which the ring 250 impacts one or more playing surfaces 220 (e.g., the first playing surface 220A and/or the second playing surface 220B) prior to reaching a target hook 230 in an effort to ensnare, couple, attach, and/or fasten the ring 250 to the target hook, as further described herein.

The string 241 can be made of a flexible material. In some embodiments the string 241 can be a rope, cord, chain, twisted twine, fishing line or the like, having sufficient strength and tension to tether the ring 250 to one of its ends. In some embodiments, the string 241 can be an elasticized cord such as a bungee cord or the like. The string 241 can be secured and/or attached to the anchoring component 240 by any suitable means including knots, adhesives, and the like.

The string 241 can be any suitable length sufficient to allow the ring 250 to reach any of the hooks 230 (e.g., the hooks 230A, the hooks 230 B, and/or the hook 230Z) and become ensnared, coupled, attached, and/or fastened to the hook 230. For example, in some embodiments the string 241 can be a length which is a certain percentage Y longer than the largest distance between the end-portion of the anchoring component 240 securing the string 241 and a hook(s) 230 of the game apparatus 200. In some embodiments the percentage Y can be no more than about 20%, no more than about 15%, no more than about 10%, no more than about 8%, no more than about 7%, no more than about 6%, no more than about 5%, inclusive of all values and ranges therebetween. In some embodiments the percentage Y can be at least about 5%, at least about 6%, at least about 7%, at least about 8%, at least about 10%, at least about 15%, at least about 20%, inclusive of all values and ranges therebetween. Combinations of the above referenced ranges for percentage Y are also possible (e.g., a percentage Y of at least about 5% to no more than about 15%, at least about 8% to no more than about 20%)

The ring 250 can be substantially similar to the ring 150 described above with reference to the game apparatus 100. For example, the ring 250 can be a shape that approximates a circular torus for at least part of its length. Alternatively, in some embodiments the ring 250 can be a ring-like member having a shape that can fit around the hooks 230, such as for example, a triangle, rectangle, square, and/or a polygon. The ring 250 can be made of any suitable material including wood, polymeric materials such as, but not limited to, polyethylene (PE), high density polyethylene (HDPE), Polypropylene (PP), polystyrene (PS), polyvinyl chloride (PVC), metals and metal alloys including, but not limited to aluminum, nickel, zinc, copper, silver, gold, steel, stainless steel, bronze, and/or the like.

As described above with reference to the game apparatus 100, the game apparatus 200 provides a plurality of hook-playing surfaces 220, offering different degrees of difficulty, and multiple modalities of tossing the ring 250 (e.g., multiple ring 250 trajectories) to ensnare, couple, attach, and/or fasten the ring 250 to a hook 230. Each hook 230 can be assigned a score and/or point value that can be awarded to the player that successfully tosses the ring 250 and ensnares, couples, attaches, and/or fastens the ring 250 to that particular hook 230. The number of points that a particular hook 230 is assigned can be related to the degree of difficulty of the toss required to successfully attach the ring 250 to that particular hook 230. Table 1 shows example score and/or a point values that can be assigned to each hook 230 included in the game apparatus 200.

TABLE 1

Individual scores and/or point values assigned to each hook

| Hook | Score and/or point value |
|---|---|
| 230A-1 | 20 points |
| 230A-2 | 30 points |
| 230A-3 | 80 points |
| 230B-2 | 60 points |
| 230B-1 | 40 points |
| 230Z | 100 points |

The game apparatus 200 can be used to play different types of games. For example, in some instances a plurality of players can use the game apparatus 200 to play a fix number of throws game. In the fix number of throws game each player is allowed to toss the ring 250 a fixed number of times. In some implementations, each player can execute all his/her allowed throws continuously and uninterruptedly, one player at a time. That is, a first player can be allowed to execute all his/her allowed number of throws continuously and uninterruptedly until completing the total number allowed throws. Then a second player can be allowed to execute all his/her allowed number of throws continuously and uninterruptedly until completing the total number allowed throws. This procedure can be followed until all the players execute all their allowed number of throws. Alternatively, in other implementations each player is allowed to execute a subset of throws one player at a time until all the players execute their subset of throws. This procedure can be repeated until all the players have executed their total number of throws. Each player can be assigned a total score based on the number of throws in which the ring 250 was successfully ensnared, coupled, attached, and/or fastened to each hook and the score and/or point value of each one of those hooks, as shown, for example in Table 1. The player that archives the highest score wins the fix number of throws game.

In some instances, one or more players can use the game apparatus 200 to play an all-hooks game. In the all-hooks game, the players are allowed to execute one throw at a time sequentially (e.g., one player after the other) until a player successfully ensnares, couples, attaches, and/or fastens the ring 250 to each one of the hooks in the game apparatus 200. Said in other words, the first player to successfully couples the ring 250 at least one time to each one of the hooks 230 wins the all-hooks game.

Figure 7:
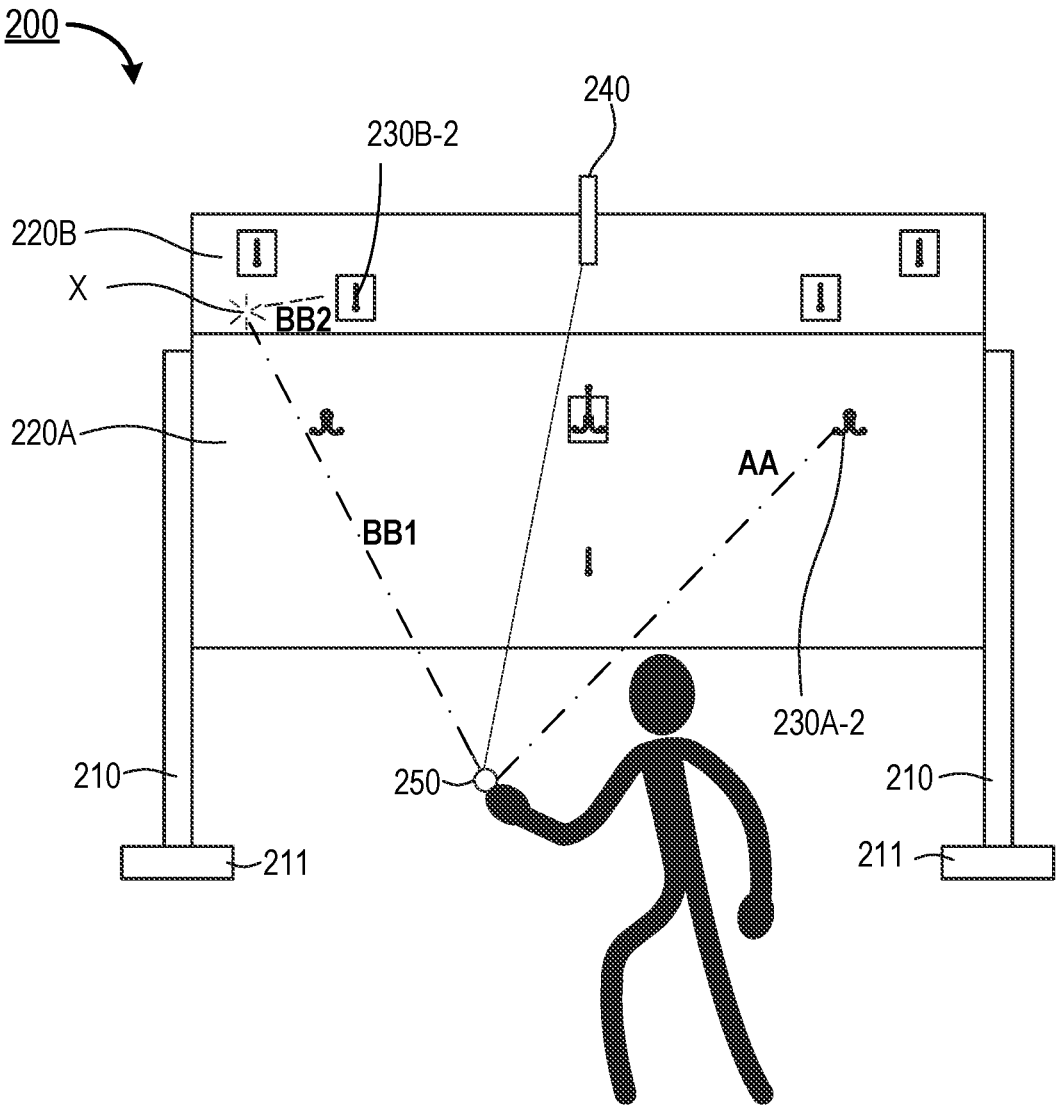
FIGS. 7 and 8 are front view schematic illustrations of the game apparatus of FIG. 2, showing possible trajectories of a ring tossed by a player to couple the ring to different hooks disposed and/or located on the playing surfaces of the game apparatus shown in FIG. 2.

The game apparatus 200 offers multiple modalities and/or methods of tossing the ring 250 (e.g., multiple ring 250 trajectories) to ensnare, couple, attach, and/or fasten the ring 250 to a hook 230 (e.g., a target hook 230) disposed on a playing surface 220. For example, in some instances a player can toss the ring 250 in such a way that the ring 250 travels according to a first predetermined trajectory (also referred to as a direct trajectory) from the hand of the player to the playing surface 220 (e.g., the playing surface 220A or the playing surface 220B) where the ring 250 becomes attached and/or coupled to the target hook 230. In the direct trajectory the ring 250 follows a pendulum-like path that starts at the hand of the player and ends on the playing surface 220 where the ring 250 is attached and/or coupled to the target hook 230 without coming in contact (e.g., hitting, touching, or bumping) with any other component and/or surface of the game apparatus 200 prior to becoming attached to the hook 230. For example, FIG. 7 shows a front view schematic illustration of the apparatus 200 displaying a modality of tossing the ring 250 according to a direct trajectory. FIG. 7 shows the ring 250 can be released from the hand of the player to follow a path AA towards the target hook 230A-2. Along the path AA the ring 250 does not come into contact (e.g., hits, touches and/or bumps) with any other component and/or surface of the game apparatus 200 prior to reaching the surface 220A and becoming attached and/or coupled to the hook 230A-2.

Figure 8:
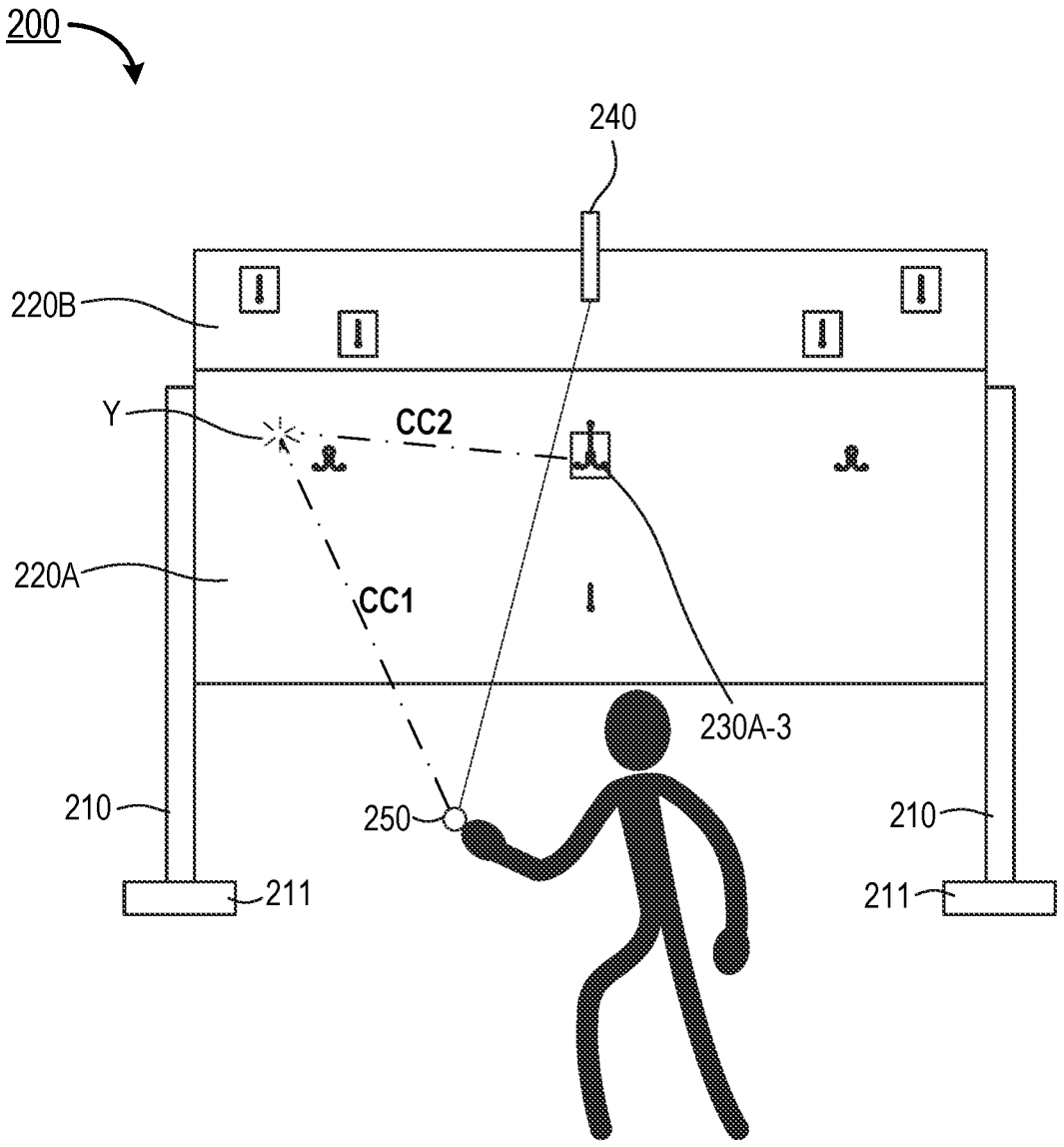

In some instances, a player can toss the ring 250 in such a way that the ring 250 travels according to a second predetermined trajectory (also referred to as a one-stop trajectory) from the hand of the player to the playing surface 220 (e.g., the playing surface 220A or the playing surface 220B) where the ring 250 becomes attached and/or coupled to the target hook 230. In the one-stop trajectory the ring 250 travels from a hand of a player to the target hook 230, with the ring 250 contacting a first point and/or small area of the game apparatus 200 prior to reaching the target hook 230. In the one-stop trajectory the player can toss the ring 250 such that the ring 250 is released from the hand of the player to follow a first path until coming in contact (e.g., hitting, touching and/or bumping) with a point and/or small area of the game apparatus 200 (e.g., a point and/or small area of the first playing surface 220A, the second playing surface 220B, or the anchoring component 240). The ring 250 can then rebound off the point and/or small area of the game apparatus 200 and follow a second path until reaching the target hook 230 and becoming attached, and/or coupled to the target ring 230. For example, FIG. 7 displays a modality of tossing the ring 250 according to a one-stop trajectory. As shown in FIG. 7, the ring 250 can be released from a hand of a player to follow a first path BB1 and come in contact (e.g., hit, touch and/or bump) with a point and/or small area X of the second playing surface 220B. The ring 250 can then rebound off the small area X of the second playing surface 220B and follow the path BB2 to become attached and/or coupled to the target hook 230B-2. Similarly, FIG. 8. shows a front view schematic illustration of the game apparatus 200, displaying a modality of tossing the ring 250 according to a one-stop trajectory. As shown in FIG. 8, the ring 250 can be released from a hand of a player to follow a first path CC1 and come in contact (e.g., hit, touch and/or bump) with a point and/or small area Y of the first playing surface 220A. The ring 250 can then rebound off the point and/or small area Y of the first playing surface 220A and follow the path CC2 to become attached and/or coupled to the target hook 230A-3.

Figure 9:
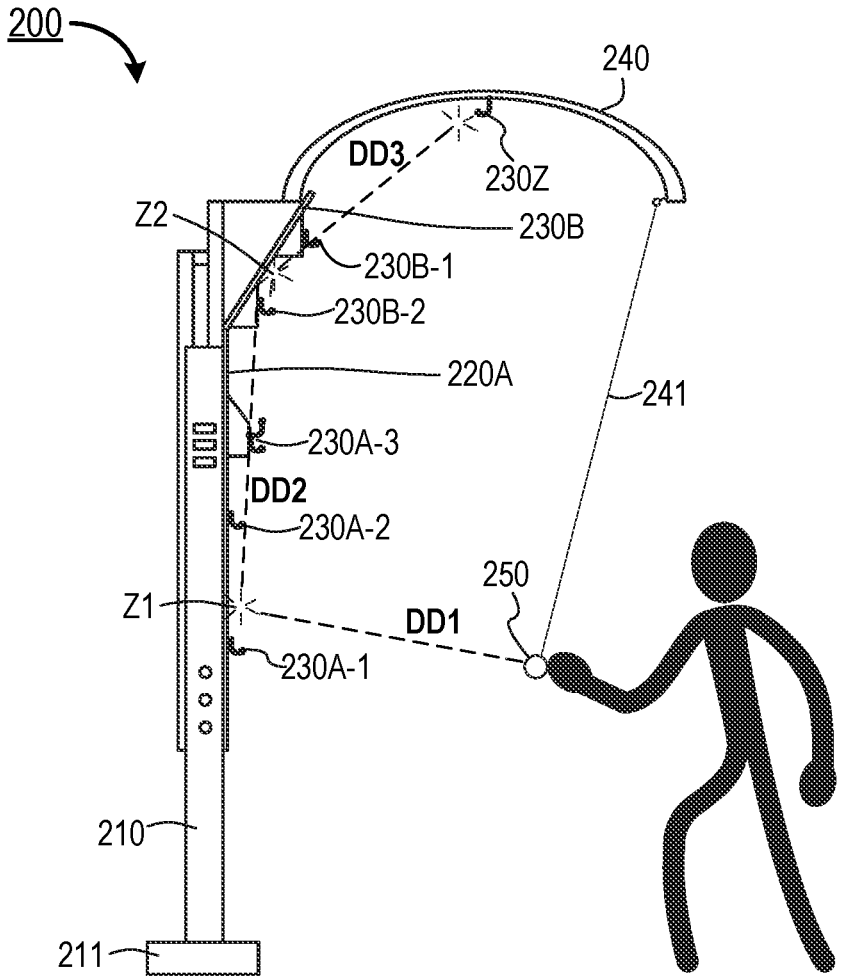
FIG. 9 is a side view schematic illustration of the game apparatus of FIG. 2, showing a trajectory of a ring tossed by a player to couple the ring to a hook disposed on an anchoring component of the game apparatus.

In some instances, a player can toss the ring 250 in such a way that the ring 250 travels according to a third predetermined trajectory (also referred to as a two-stop trajectory) from the hand of the player to the playing surface 220 (e.g., the playing surface 220A or the playing surface 220B) where the ring 250 becomes attached and/or coupled to the target hook 230. In the two-stop trajectory the ring 250 travels from a hand of the player to the target hook 230, with the ring 250 contacting a first point and/or small area of the game apparatus 200, and then a second point and/or small area of the game apparatus 200 (the second point being different from the first point), prior to reaching the target hook 230. In the two-stop trajectory the player can toss the ring 250 such that the ring 250 is released from the hand of the player to follow a first path until coming in contact (e.g., hitting, touching and/or bumping) with a first point and/or first small area of the game apparatus 200 (e.g., a first point and/or first small area of either the first playing surface 220A, or the second playing surface 220B). The ring 250 can then rebound off the first point and/or small area of the game apparatus 200 and follow a second path until reaching a second point and/or second small area of the game apparatus 200 (e.g., a second point and/or second small area of either the first playing surface 220A, or the second playing surface 220B, the second point and/or small area being different from the first point and/or first small area). The ring 250 can then rebound off the second point and/or small area of the game apparatus 200 and follow a third trajectory until reaching the target hook 230 and becoming attached and/or coupled to the target ring 230. For example, FIG. 9 shows a side view schematic illustration of the game apparatus 200, displaying a modality of tossing the ring 250 according to a two-stop trajectory. FIG. 9 shows the ring 250 can be released from a hand of a player to follow a first path DD1 and come in contact (e.g., hit, touch and/or bump) with a first point and/or small area Z1 of the first playing surface 220A. The ring 250 can then rebound off that first point and/or small area Z1 of the first playing surface 220A and follow the path DD2 until coming in contact (e.g., hitting, touching and/or bumping) with a second point and/or small area Z2 of the second playing surface 220B. The ring 250 can then rebound off the second point and/or small area Z2 of the second playing surface 220B and follow the path DD3 to become attached and/or coupled to the hook 230Z.

While various embodiments have been described above, it should be understood that they have been presented by way of example only, and not limitation. While the embodiments have been particularly shown and described, it will be understood that various changes in form and details may be made. Where schematics and/or embodiments described above indicate certain components arranged in certain orientations or positions, the arrangement of components may be modified. Although various embodiments have been described as having particular features and/or combinations of components, other embodiments are possible having a combination of any features and/or components from any of embodiments as discussed above.

The invention claimed is:

1. An apparatus, comprising:

a support component;

a first playing surface coupled to the support component, the first playing surface defining a first plane and including a first plurality of hooks disposed on the first plane;

a second playing surface coupled to the support component, the second playing surface defining a second plane disposed above the first plane and different from the first plane, the second playing surface including a second plurality of hooks disposed on the second plane;

an elongated anchoring component having a first end coupled to the support component, and a second end extending away from the first playing surface and the second playing surface;

a string coupled to the second end of the anchoring component, the string having a length sufficient to reach each hook of the first plurality of hooks and each hook of the second plurality of hooks; and a ring coupled to the string.

2. The apparatus of claim 1, wherein the support component includes two legs.

3. The apparatus of claim 1, wherein the first plurality of hooks includes:

a first hook disposed near to a first side of the first playing surface;

a second hook disposed near to a second side of the first playing surface opposite to the first side and;

a third hook and a fourth hook disposed on a central portion of the first playing surface.

4. The apparatus of claim 3, wherein at least one of the third hook or the fourth hook is disposed on a platform, the platform being coupled to the first playing surface.

5. The apparatus of claim 1, wherein the first plane and the second plane define an angle of about 60°.

6. The apparatus of claim 1, wherein the second plurality of hooks includes:

a first hook and a second hook disposed near to a first side of the second playing surface; and a third hook and a fourth hook disposed near a second side of the second playing surface opposite to the first side.

7. The apparatus of claim 1, wherein the anchoring component is cantilevered over the second playing surface.

8. The apparatus of claim 1, wherein the anchoring component has an arch shape.

9. The apparatus of claim 8, wherein the anchoring component includes a hook.

10. An apparatus, comprising:

a first playing surface;

a first hook disposed on the first playing surface;

a second playing surface oriented at an angle with respect to the first playing surface and disposed above the first playing surface;

a second hook disposed on the second playing surface;

an anchoring component having a first end coupled to the second playing surface, and a second end extending away from the second playing surface;

a string coupled to the second end of the anchoring component, the string having a length sufficient to reach the first hook and the second hook; and a ring coupled the string.

11. The apparatus of claim 10, wherein the ring is configured to travel along a first trajectory in which the ring contacts the first playing surface and becomes coupled to the first hook.

12. The apparatus of claim 10, wherein the ring is configured to travel along a second trajectory in which the ring contacts the first playing surface, rebounds off the first playing surface and becomes coupled to the first hook.

13. The apparatus of claim 10, wherein the ring is configured to travel along a second trajectory in which the ring contacts the second playing surface, rebounds off the second playing surface and then becomes coupled to the second hook.

14. The apparatus of claim 10, further comprising a third hook coupled to the anchoring component, wherein the length of the string is sufficient to reach the third hook.

15. The apparatus of claim 14, wherein the ring is configured to travel along a third trajectory in which the ring contacts the first playing surface, rebounds off the first playing surface after the contacting the first playing surface, and then contacts the second playing surface, rebounds off the second playing surface after the contacting the second playing surface, and then becomes coupled to the third hook.

16. The apparatus of claim 10 further comprising a support component coupled to the first playing surface and configured to provide support to the apparatus.

17. The apparatus of claim 16, wherein the support component includes two legs.

18. The apparatus of claim 10, wherein the second playing surface is oriented at an angle with respect the first playing surface of about 60°.

19. The apparatus of claim 10, wherein the anchoring component is cantilevered to the second playing surface.

20. The apparatus of claim 10, wherein the anchoring component has an arch shape.

* * * * *